US011540617B2

(12) United States Patent
LeMarbe

(10) Patent No.: US 11,540,617 B2
(45) Date of Patent: Jan. 3, 2023

(54) FLEXIBLE MATERIAL WITH MOLLE CUT PATTERN

(71) Applicant: Point Blank Enterprises, Inc., Pompano Beach, FL (US)

(72) Inventor: Randall Jered LeMarbe, Coral Springs, FL (US)

(73) Assignee: Point Blank Enterprises, Inc., Pompano Beach, FL (US)

( * ) Notice: Subject to any disclaimer, the term of this patent is extended or adjusted under 35 U.S.C. 154(b) by 261 days.

(21) Appl. No.: 16/904,285

(22) Filed: Jun. 17, 2020

(65) Prior Publication Data

US 2020/0315332 A1 Oct. 8, 2020

Related U.S. Application Data

(63) Continuation of application No. 16/252,319, filed on Jan. 18, 2019, now Pat. No. 11,109,664, which is a (Continued)

(51) Int. Cl.
*F41H 1/02* (2006.01)
*A45F 5/02* (2006.01)

(Continued)

(52) U.S. Cl.
CPC ..... *A45F 5/022* (2013.01); *A41D 1/04* (2013.01); *F41H 1/02* (2013.01);

(Continued)

(58) Field of Classification Search
CPC ..... A45F 5/022; A45F 2003/003; A45F 2005/002; A41D 1/04; F41H 1/02; A56F 2005/023

See application file for complete search history.

(56) References Cited

U.S. PATENT DOCUMENTS 5,263,618 A 11/1993 Talavera
7,251,835 B2 8/2007 Learmont (Continued)

FOREIGN PATENT DOCUMENTS

EP 1772696 A1 4/2007
GB 2544551 A 5/2017
WO WO-2009051619 A2 4/2009

OTHER PUBLICATIONS

Canadian Office Action for Application 3045861 dated Nov. 9, 2020.

(Continued)

*Primary Examiner* — Katherine M Moran
(74) *Attorney, Agent, or Firm* — Honigman LLP

(57) ABSTRACT

An attachment system includes a wearable carrier and an attachment slot. The wearable carrier is formed at least in part from a flexible material having an outer surface and an inner surface opposite the outer surface. The attachment slot is formed through the flexible material and configured to receive a strap of an attachment accessory. The attachment slot extends from a first end to a second end and includes a first segment, a second segment, and a third segment. The first segment extends from the first end to the second segment. The second segment extends from the first segment to the third segment. The third segment extends from the second segment to the second end. The first segment and the second segment define a first non-orthogonal angle therebetween. The third segment and the second segment define a second non-orthogonal angle therebetween.

17 Claims, 18 Drawing Sheets

Related U.S. Application Data continuation-in-part of application No. 16/023,976, filed on Jun. 29, 2018, now abandoned.

(51) Int. Cl.

| | |
|---|---|
| ***A41D 1/04*** | (2006.01) |
| *A45F 5/00* | (2006.01) |
| *A45F 3/00* | (2006.01) |

(52) U.S. Cl.

CPC ... *A45F 2003/003* (2013.01); *A45F 2005/002* (2013.01); *A45F 2005/023* (2013.01)

(56) References Cited

U.S. PATENT DOCUMENTS

| | | | | |
|---|---|---|---|---|
| 8,608,041 | B1 * | 12/2013 | Adkisson | A45F 3/04 2/102 |
| 9,144,255 | B1 * | 9/2015 | Perciballi | A41D 27/00 |
| 9,173,436 | B2 | 11/2015 | Crye | |
| 9,565,922 | B2 | 2/2017 | Cole et al. | |
| 9,974,379 | B2 | 5/2018 | Cole et al. | |
| 10,143,294 | B1 * | 12/2018 | Matson | A45F 5/02 |
| 11,109,664 | B2 * | 9/2021 | LeMarbe | A45F 5/022 |
| 2012/0186433 | A1 | 7/2012 | Braiewa et al. | |
| 2015/0272244 | A1 * | 10/2015 | Vito | A45F 5/02 2/463 |
| 2015/0335140 | A1 * | 11/2015 | Cole | A45F 5/02 24/3.1 |

OTHER PUBLICATIONS

European Search Report for Application No. EP 19183062 dated Oct. 14, 2019.

Office Action from U.S. Appl. No. 16/023,976 dated Feb. 1, 2019.

Office Action from U.S. Appl. No. 16/023,976 dated Aug. 23, 2019.

Office Action from U.S. Appl. No. 16/185,928 dated Feb. 1, 2019.

Office Action from U.S. Appl. No. 16/185,928 dated Aug. 1, 2019.

* cited by examiner

FLEXIBLE MATERIAL WITH MOLLE CUT PATTERN

CROSS REFERENCE TO RELATED APPLICATIONS

This U.S. patent application is a continuation of, and claims priority under 35 U.S.C. § 120 from, U.S. patent application Ser. No. 16/252,319, filed on Jan. 18, 2019 and now issued as U.S. Pat. No. 11,109,664, which is a continuation-in-part of U.S. Non-Provisional application Ser. No. 16/023,976, filed on Jun. 29, 2018 and now abandoned, the disclosures of which are considered part of the disclosure of this application and are hereby incorporated by reference in their entireties.

TECHNICAL FIELD

This disclosure relates to a flexible material with a MOLLE cut pattern.

BACKGROUND

Carrying equipment for military and enforcement personnel has taken many forms over the years. These forms have evolved to take advantage of developments such as lightweight materials and new designs. For example, basic cotton canvas rucksacks evolved to nylon load carrying equipment (LCE). Where possible, designs modified hardware from brass and steel to aluminum and plastic. Load carrying equipment included new forms resembling a belt and suspenders with attachments for ammunition cases, canteens, tools, first-aid, etc. Different models incorporated snap fasteners and hook and loop fasteners for quick-release functionality. Attachments snapped to snap fastening eyelets. Load carrying equipment became all-purpose lightweight individual carrying equipment (ALICE) and subsequently modular lightweight load carrying equipment (MOLLE). Carrying equipment integrated the pouch attachment ladder system (PALS) with a grid of nylon webbing sewn into tactical gear, such as backpacks and modular tactical vests. With the pouch attachment ladder system, attachments could be interwoven into the webbing grid; allowing both attachment and detachment with relative ease.

SUMMARY

One aspect of the disclosure provides an attachment slot. The flexible material attachment slot includes a layer of flexible material and a cut formed within the layer of flexible material. In some configurations, the flexible material includes a ballistic resilient fabric. The layer of flexible material has an exterior surface and an interior surface opposite the exterior surface. The cut formed within the layer of flexible material that extends from the exterior surface to the interior surface. Here, the cut includes a first cut end, a second cut end, a first segment, a second segment, and a third segment. The first segment extends from the first cut end to the third segment and has a first curvature defined by a first radius of curvature at a first intersection between the first segment and the third segment. The second segment extends from the second cut end to the third segment and has a second curvature defined by a second radius of curvature at a second intersection between the second segment and the third segment. The third segment has a third segment length that extends from the first intersection to the second intersection. In some examples, the third segment may tangentially intersect at least one of the first segment or the second segment.

Implementations of the disclosure may include one or more of the following optional features. In some implementations, the cut defines an inner flexible material region and an outer flexible material region. In these implementations, the inner flexible material region is surrounded by the first segment, the second segment, and the third segment. Moreover, the inner flexible material region may be movable relative to the outer flexible material region between a first position and a second position. In the first position, a first portion of the exterior surface of the inner region adjacent to the third segment of the cut extends beyond the interior surface of the outer flexible material region. In the second position, a second portion of the interior surface of the inner region adjacent to the third segment of the cut extends beyond the exterior surface of the outer flexible material region. Optionally, the first segment and the second segment are convex with respect to the inner flexible material region.

In some examples, the first segment extends in a first direction and the second segment extends in a second direction. In these examples, the first direction and the second direction are the same direction. For example, the first direction and the second direction are parallel. In some configurations, the first segment and the second segment have equal lengths.

In some implementations, each edge of the cut includes sealed unraveled fibers of the flexible material. The cut may be formed by melting the layer of the flexible material. The attachment slot may further include a second cut formed within the layer of flexible material that extends from the exterior surface to the interior surface. The second cut may be vertically aligned and spaced apart from the cut.

Another aspect of the disclosure provides an attachment system. The attachment system includes a wearable ballistic resilient carrier with a first cut and a second cut formed within the wearable ballistic resilient carrier. The wearable ballistic resilient carrier has an outer surface and an opposite inner surface. The inner surface is configured to face a wearer of the wearable ballistic resilient carrier. The first cut has a first cut first end and a first cut second end. The first cut also defines a pivotable first tab where the pivotable first tab includes a first radius of curvature and a second radius of curvature. The first radius of curvature is adjacent to the first cut first end and the second radius of curvature is adjacent to the first cut second end. The pivotable first tab is configured to receive a strap from an attachment pouch by pivoting toward the wearer of the wearable ballistic resilient carrier. The second cut is spaced apart from and vertically aligned with the first cut. The second cut has a second cut first end and a second cut second end. The second cut also defines a pivotable second tab where the pivotable second tab includes a third radius of curvature and a fourth radius of curvature. The third radius of curvature is adjacent to the second cut first end and the fourth radius of curvature is adjacent to the second cut second end. The pivotable second tab is configured to receive the strap from the attachment pouch by pivoting away from the wearer of the wearable ballistic resilient carrier.

In some implementations, the first cut and the second cut are each pivotable along an axis that extends from the first end to the second end. The edge of the first cut and the second cut may include sealed, unraveled fibers of a ballistic resilient fabric. In some examples, each of the first cut and the second cut is formed by melting flexible material of the wearable ballistic resilient carrier. In some configurations, the strap is a MOLLE webbing strap.

Another aspect of the disclosure provides a method for forming an attachment slot. The method includes providing ballistic resilient flexible material where the ballistic resilient flexible material has an exterior surface and an interior surface opposite the exterior surface. The method further includes cutting at least two vertically aligned cuts through the ballistic resilient flexible material from the exterior surface to the interior surface. Each cut includes a first cut end, a second cut end, a first segment, a second segment, and a third segment. The first segment extends from the first cut end to the third segment and has a first curvature defined by a first radius of curvature at a first intersection between the first segment and the third segment. The second segment extends from the second cut end to the third segment and has a second curvature defined by a second radius of curvature at a second intersection between the second segment and the third segment. The third segment has a third segment length that extends from the first intersection to the second intersection.

This aspect may include one or more of the following optional features. In some examples, cutting at least two vertically aligned cuts includes melting the ballistic resilient flexible material. Here, melting the ballistic resilient flexible material may include a laser cutter melting the ballistic resilient flexible material.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1A:
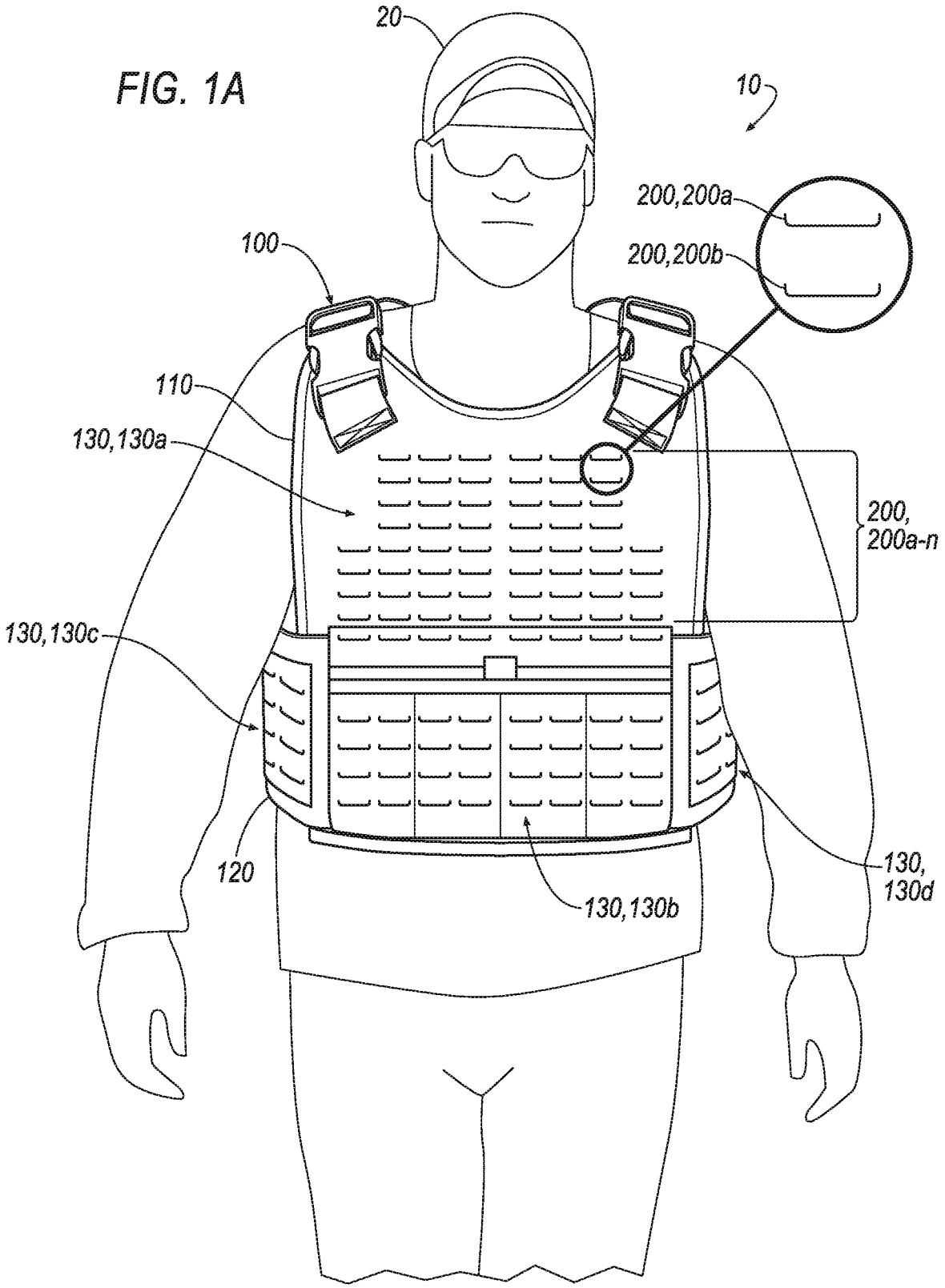
FIGS. 1A and 1B are perspective views of example ballistic environments.
Figure 1B:
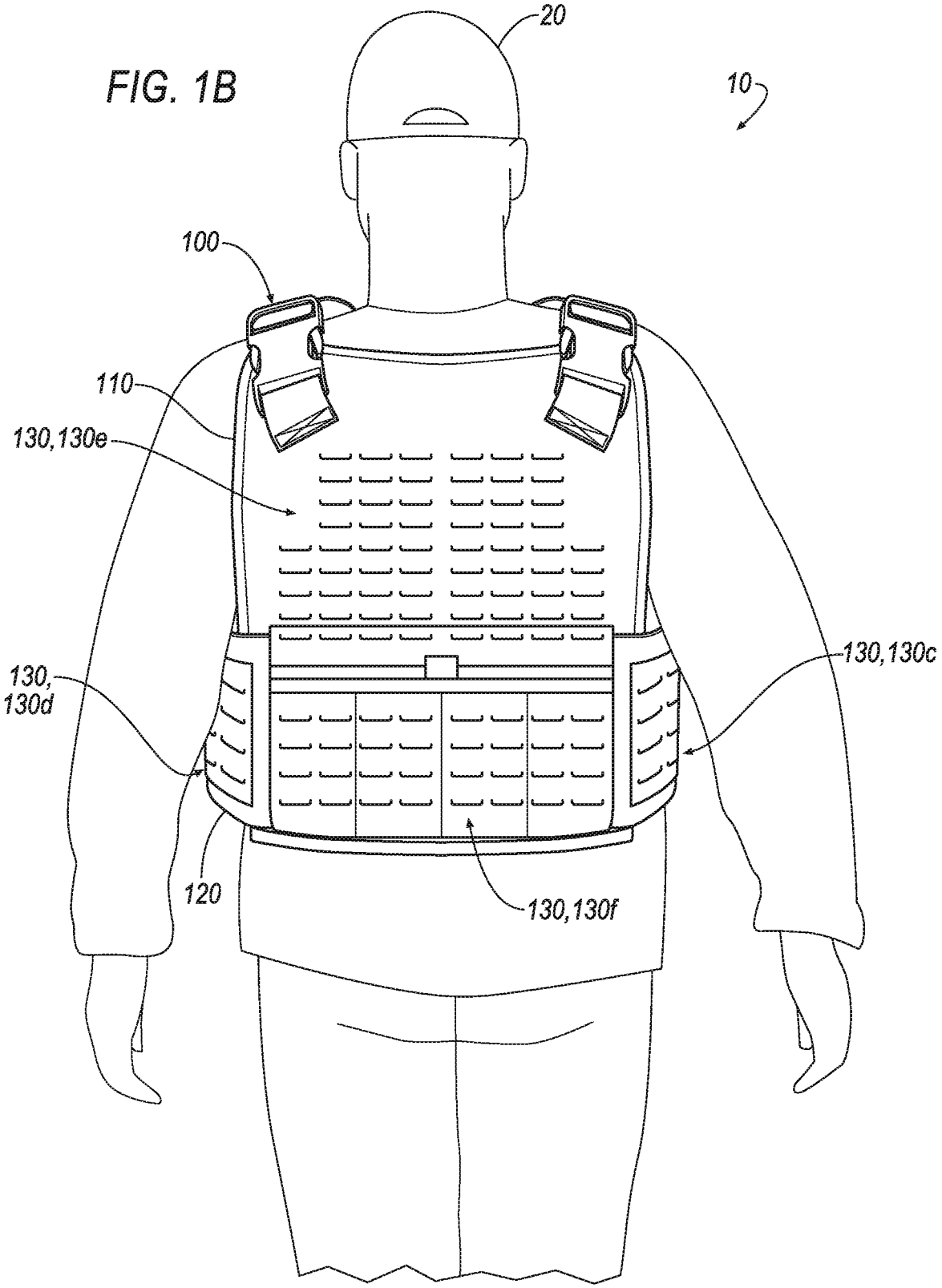

FIGS. 1A and 1B are examples of a ballistic environment 10. In some implementations, the ballistic environment 10 includes a wearer 20 and a carrier 100. Here, the carrier 100 includes a tactical vest 110 and a cummerbund 120. Yet generally, a carrier 100 is a doffable and donable wearable that is configured for load bearing equipment. The carrier 100 may include any or all articles of clothing such as a vest, suspenders, a belt (e.g., a cummerbund), sleeves, shoulder pads, shorts, pants, a jacket, backpack, etc.

In some examples, the wearable carrier 100 is ballistic resilient. Here, a ballistic resilient carrier 100 refers to a carrier 100 designed to impede (e.g., reduce) ballistic penetration (e.g., from bullets, shrapnel, or other penetrating objects). To impede ballistic penetration, the carrier 100 may be formed from various combinations of flexible material including various woven, non-woven, synthetic, and/or natural fibers. These fibers may collectively define a layer of flexible material (e.g., a layer of fabric). In some implementations, the flexible material includes a polymeric substance (e.g., a rubber or other elastomer). In some examples, multiple layers of flexible material (e.g., fabric) are used to construct the carrier 100. Multiple layers may be used for the flexible material to increase strength, reduce fraying, or in certain circumstances contribute stiffness to the flexible material. For instance, at least one layer of a multi-layer construction of the flexible material includes a coated layer (e.g., spray coated, air knife coated, flexo-coated, gravure coated, immersion coated, etc.). Additionally or alternatively, multi-layer assemblies may be laminated together to form plies. In some implementations, a carrier 100 may be constructed from multiple plies. In other examples, a single layer is used to construct the carrier 100. In some configurations, aramid fibers, such as Nomex®, Kevlar®, Twaron®, Technora®, ultra-high-molecular-weight polyethalene (e.g., Dyneema®), Nylon, Cordura®, etc. form the carrier 100 to enable ballistic resilience.

Figure 3A:
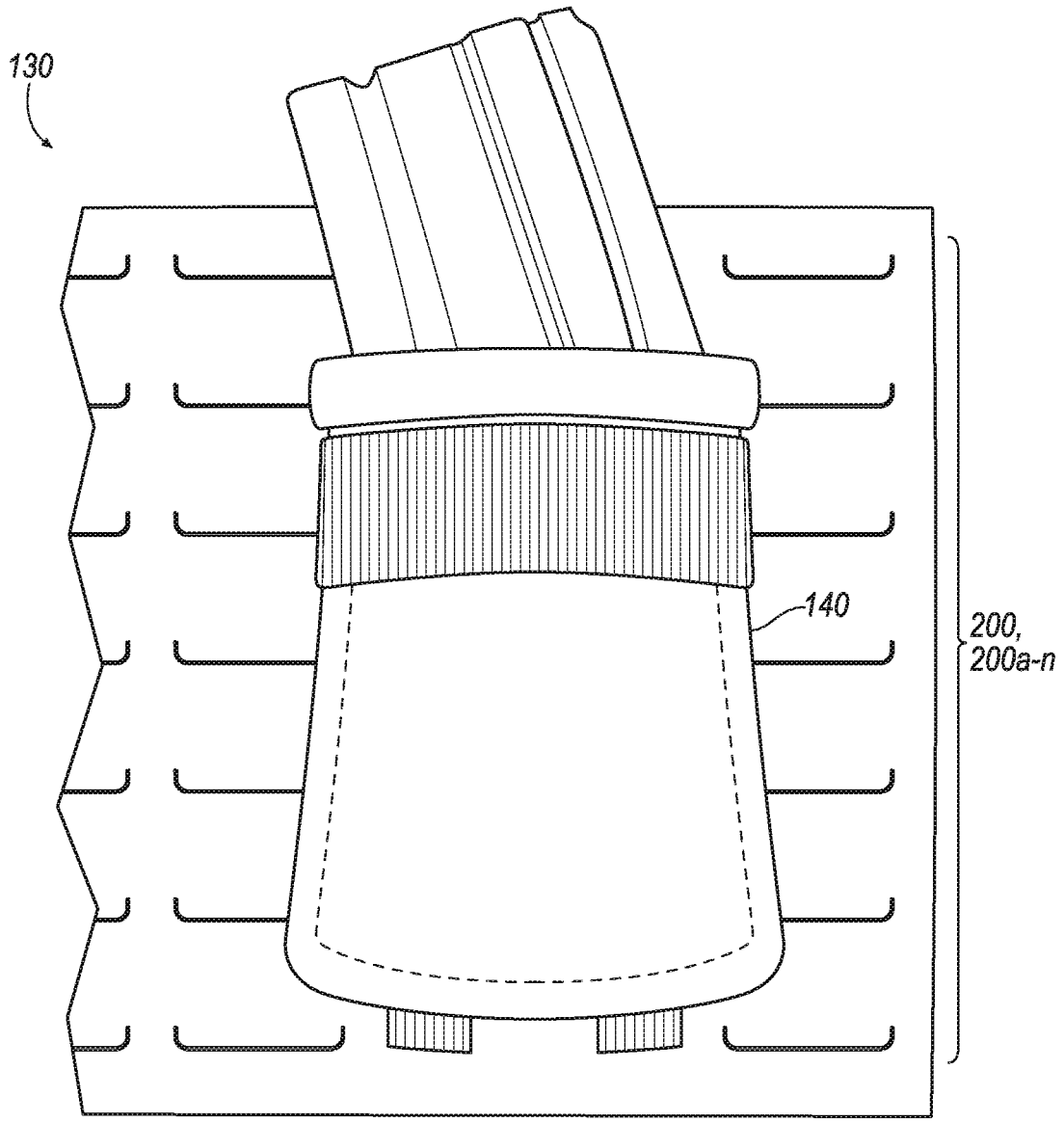
FIG. 3A is a perspective view of an example tactical attachment attached via an attachment slot.

Referring to FIGS. 1A and 1B, the carrier 100 has a several attachment sites 130. Each attachment site 130 is an area where the wearer 20 may fasten a tactical attachment 140 (FIG. 3A) to the carrier 100, such as ammunition cases, canteens, tools, first-aid, or other tactical equipment. For example, the tactical attachment 140 is in the form of a pouch (FIG. 3A). The carrier 100 may be designed such that any location or area on a surface of the carrier 100 may include an attachment site 130. In some examples, the carrier 100 includes additional structures such as platforms, pouches, or pockets. These additional structures may also include attachments sites 130 as part of the carrier 100. In some implementations, the additional structures are compartments for armor inserts such as hard ballistic panels.

FIGS. 1A and 1B are examples of attachment sites 130. FIG. 1A is a front view of the wearer 20 with the carrier 100 and includes four attachment sites 130, 130*a-d*: a first attachment site 130, 130*a* at a chest area of the wearer 20, a second attachment site 130, 130*b* at a stomach area of the wearer 20, and a third attachment site 130, 130*c* and a fourth attachment site 130, 130*d* at sides (i.e. obliques) of the wearer 20 along the cummerbund 120. Similarly, FIG. 1B is a rear view of the wearer 20 with the carrier 100 and includes two additional attachment sites 130, 130*e-f*, a fifth attachment site 130, 130*e* at an upper back area of the wearer 20 and a sixth attachment site 130, 130*f* at a lower back area of the wearer 20, as well as a partial depiction of the third attachment site 130, 130*c* and the fourth attachment site 130, 130*d* along the cummerbund 120.

In some configurations, an attachment site 130 includes at least two attachment slots 150, 150*a-b*. With each attachment site 130 including at least two attachment slots 150, 150*a-b*, an attachment portion 142 of the tactical attachment 140 may be woven into (i.e. enter) a first attachment slot 150, 150*a* and woven out (i.e. exit) of a second attachment slot 150, 150*b* (e.g., as shown by FIGS. 3A-3E). In some examples, the attachment portion 142 is a strap (e.g., a flat nylon webbing strap compatible with PALS). This weaving pattern by the attachment portion 142 secures the tactical attachment 140 to the carrier 100 at the attachment site 130. In some implementations, the attachment portion 142, upon exiting the second attachment slot 150, 150*b*, additionally secures to the tactical equipment attachment 140. For example, the attachment portion 142 fastens to the tactical equipment attachment 140 by a fastener (e.g., a snap or a buckle) or an attachment site 130 on the tactical equipment attachment 140. Generally, an attachment site 130 includes an array of attachment slots 150, 150*a-n* such that the wearer 20 may customize and/or optimize carrying tactical equipment. Yet, in some examples, the attachment site 130 is a single attachment slot 150 such that the attachment portion 142 of the tactical equipment attachment 140 secures to an interior portion of the carrier 100 without being woven out of (i.e. exiting) a respective second attachment slot 150 (e.g., the second attachment slot 150, 150*b*).

FIGS. 2A-2F are examples of various designs of the attachment slot 150. In some examples, the attachment slot 150 is a cut (or slit) 200 formed within a layer 102 of flexible material of the carrier 100. In this example, the attachment slot 150 extends from an exterior surface 102*e* of the layer 102 to an interior surface 102*i* of the layer 102 to form the cut 200. Here, the exterior surface 102*e* refers to a layer 102 that faces outward from the wearer 20; while the interior surface 102*i* refers to a surface of the layer 102 that faces inward toward the wearer 20. The attachment slot 150 may form a cut through a single layer (e.g., layer 102) or more than one layer 102, 102*a-n* (e.g., laminated layers or plies).

Figure 2A:
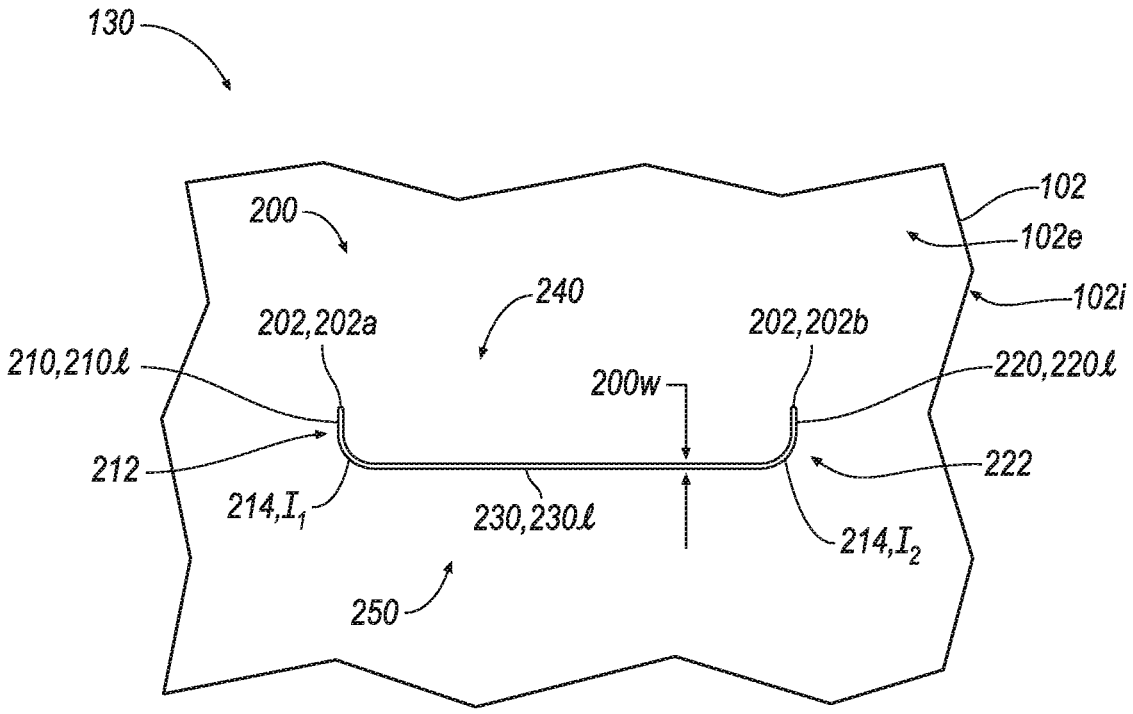
FIGS. 2A-2F are perspective views of example attachment slots for a carrier.

Referring to FIG. 2A, in some examples, the attachment slot 150 includes a first cut end 202, 202*a* and a second cut end 202, 202*b*. Between the first cut end 202, 202*a* and the second cut end 202, 202*b*, the attachment slot 150 includes a first segment 210, a second segment 220, and a third segment 230. In these examples, the first segment 210 extends from the first cut end 202, 202*a* to the third segment 230. Here, the first segment 210 has a first curvature 212 defined by a first radius of curvature 214 at a first intersection $I_1$ between the first segment 210 and the third segment 230. Similarly, the second segment 220 extends from the second cut end 202, 202*b* to the third segment 230. In these examples, the second segment 220 has a second curvature 222 defined by a second radius of curvature 214 at a second intersection $I_2$ between the second segment 220 and the third segment 230. Based on this configuration, the third segment 230 extends from the first intersection $I_1$ to the second intersection $I_2$ and has a third segment length 2301 corresponding to a distance between the first intersection $I_1$ to the second intersection $I_2$. In some examples, such as FIGS. 2A-2C, a shape of the attachment slot 150 resembles that of a U-shape. Although radius of curvatures 214, $I_1$ and 214, $I_2$ are depicted as having radius of fixed curvature, it is also possible to form curvatures 214, $I_1$ and/or 214, $I_2$ using a non-constant radius of curvature (i.e. a curvature whose radius varies over its course).

In some implementations, the curvature (e.g., the first curvature and the second curvature) of the attachment slot 150 allows carrier 100 to distribute a load from the tactical attachment 140 (i.e. an attachment load) around a length of the curvature. With a distributed attachment load throughout the curvature of the attachment slot 150, the curved shape of at least one segment (e.g., the first segment 210, the second segment 220, or the third segment 230) of the cut 200 may offset or reduce point stresses within the attachment slot 150. For example, in certain instances where the attachment load is not distributed along the curvature of the attachment slot 150, significant point stresses at the attachment slot 150 may cause the carrier 100 to tear and/or to rip at the attachment site 130. In some implementations, the distributed attachment load permits tactical attachments 150 to increase a tactical attachment's load carrying capacity without a risk of damage to the carrier 100. The distributed attachment load may also prevent failures during use of the carrier 100 where a military or an enforcement personnel places increased stress on a tactical attachment 140 and/or the carrier 100. In other words, during use of a carrier 100, a tactical attachment 140 may be tugged, grabbed, or pulled. Here, distributing the increased stress along the curvature of the attachment slot 150 reduces a likelihood that the carrier 100 fails at an attachment site 130.

Additionally or alternatively, each segment 210, 220, 230 may intersect (e.g., at the first intersection $I_1$ and/or the second intersection $I_2$) with an adjacent segment 210, 220, 230 at any angular configuration. An intersection I as an angular intersection (i.e. where the intersection of two segments forms an angle) may span any range of angles from acute, to ninety-degrees (i.e. a right angle), to obtuse. In some examples, the angle formed at the first intersection $I_1$ and the second intersection $I_2$ are the same angle; while in other examples, the angle at the first intersection $I_1$ and the second intersection $I_2$ are different angles. In yet other examples, the first intersection $I_1$ has a radius of curvature while the second intersection $I_2$ has an angular intersection or vice versa. In other words, the intersections $I_1$, $I_2$ between segments 210, 220, 230 may form any combination of a radius of curvature or an angle.

Figure 2B:
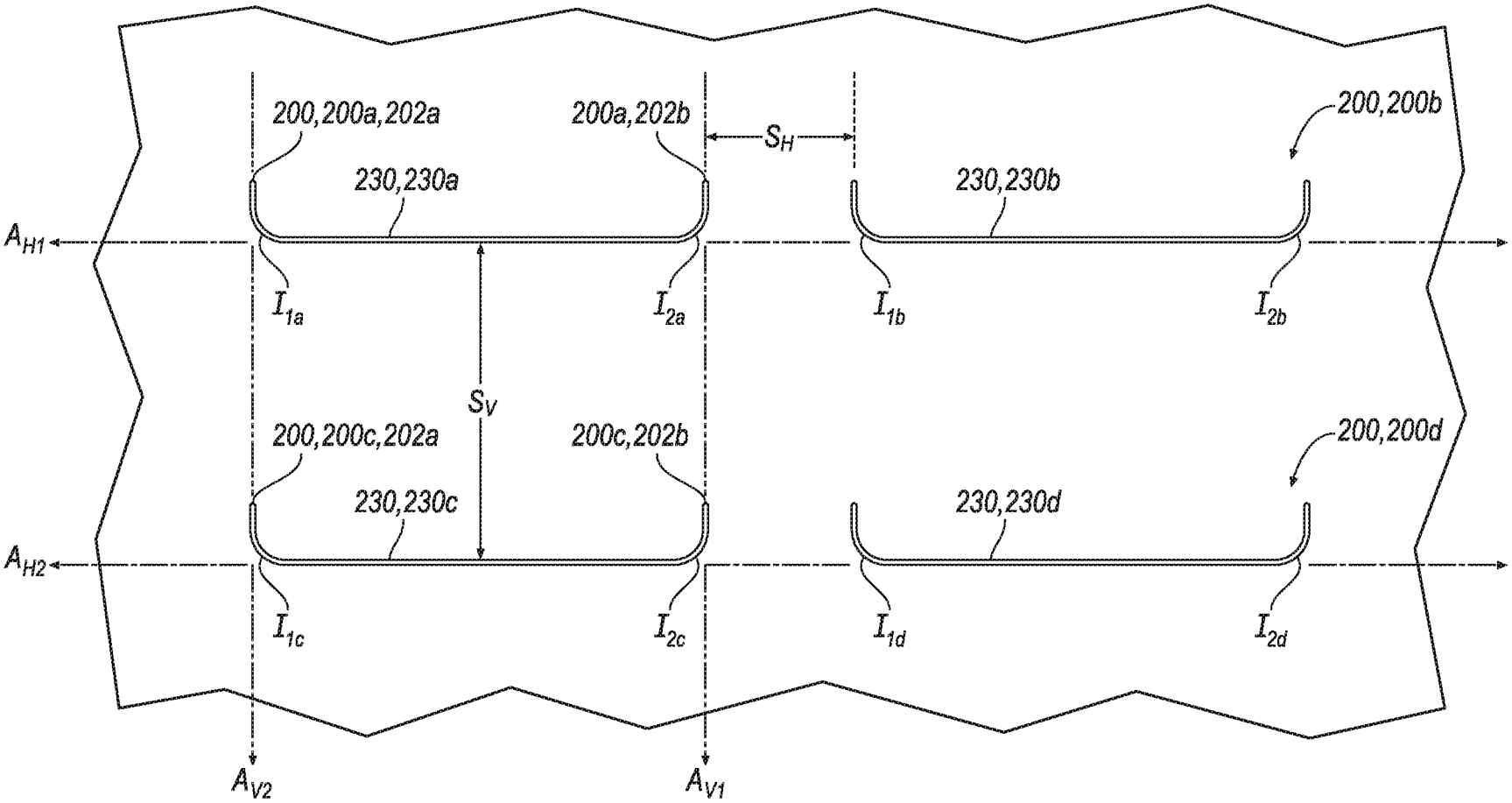
Figure 2C:
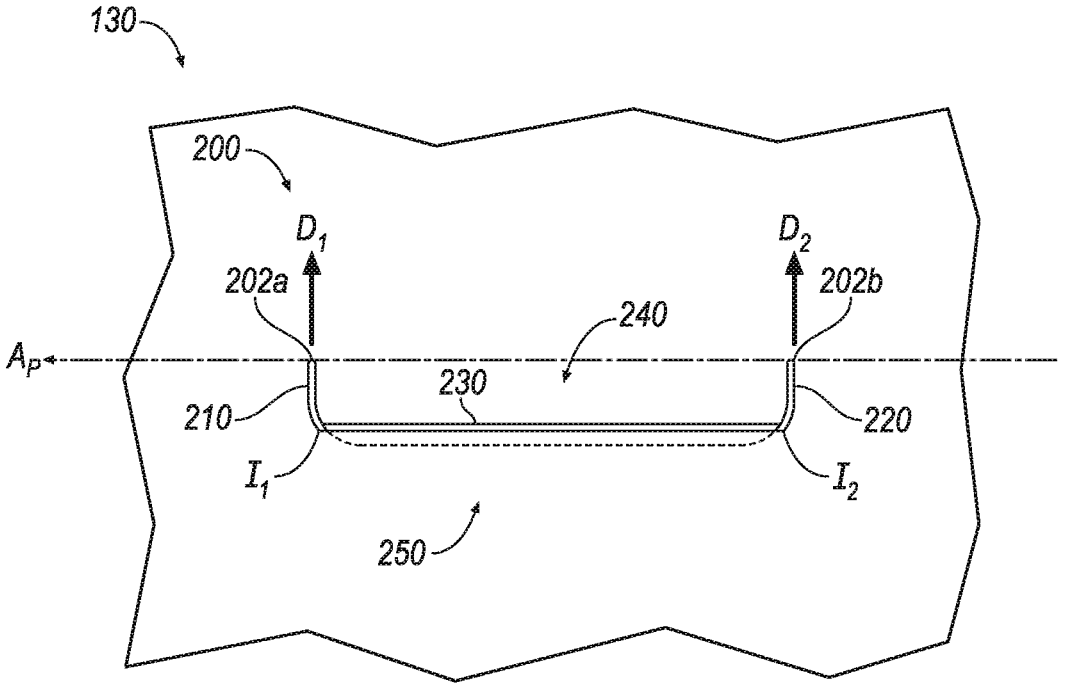
Figure 2D:
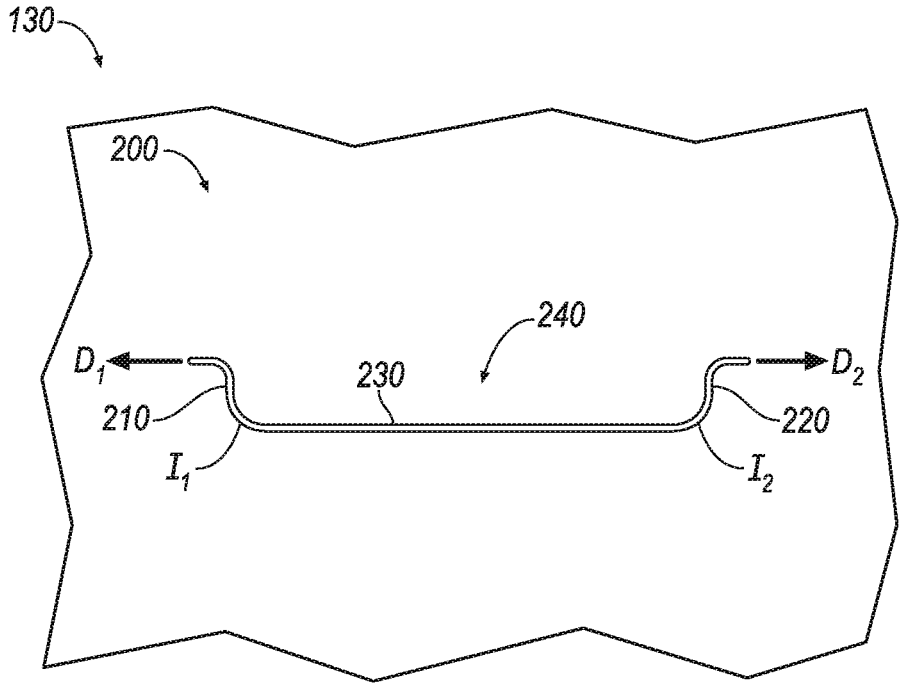
Figure 2E:
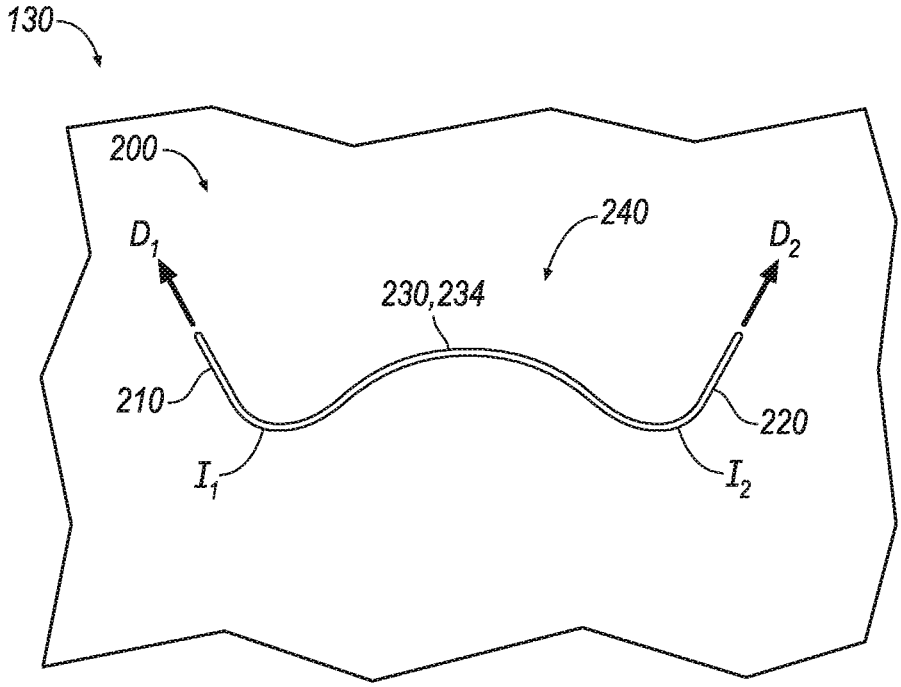

Referring to FIGS. 2A-2F, the first segment 210 and the second segment 220 extend in a first direction $D_1$ and a second direction $D_2$ respectfully. In some examples, such as FIGS. 2A-2C, the first direction $D_1$ and the second direction $D_2$ are the same directions. For example, the first direction $D_1$ and the second direction $D_2$ are parallel. In another example, the first direction $D_1$ and the second direction $D_2$ are non-parallel, but both directions extend generally toward the same direction (e.g., as shown in FIG. 2E). To illustrate, both directions may extend in a direction toward an upper torso of the wearer 20 while the first direction $D_1$ extends towards a right shoulder of the wearer 20 and the second direction $D_2$ extends towards a left shoulder of the wearer 20. In other examples, such as FIGS. 2D and 2F, the first direction $D_1$ and the second direction $D_2$ are opposite directions.

Referring further to FIGS. 2A-2F, the first segment 210 and the second segment 220 have a first segment length 2101 and a second segment length 2201, respectfully. In some examples, the first segment length 2101 is proportional and/or equal to the second segment length 2201. A proportional or equal length between the first segment length 2101 and the second segment length 2201 may allow the tactical attachment 140 to stay upright and/or maintain levelness with respect to the carrier 100. In some configurations, the first segment length 2101 is non-proportional and/or non-equal to the second segment length 2201. These configurations may be desirable for particular tactical attachments 140, such as in the case of an imbalanced tactical attachment 140.

Referring FIGS. 2A-2D, in some examples, the third segment 230 is generally linear. Although linear, the third segment 230 may intersect either the first segment 210 or the second segment 220 in different ways. For example, as shown in FIG. 2A, the third segment 230 intersects both the first segment 210 and the second segment 220 tangentially. In other examples, the third segment 230 intersects one of the first segment 210 or the second segment 220 tangentially.

In other configurations, such as FIG. 2C, the third segment 230 intersects at least one of the first segment 210 or the second segment non-tangentially. In other words, the third segment 230 may intersect either of the first segment 210 or the second segment 220 such that the intersection I forms a non-right angle between the third segment 230 and either the first radius of curvature 214 or the second radius of curvature 224.

Although FIGS. 2A-2F depict the first segment 210 and the second segment 220 as symmetrical about the third segment 230 (e.g., symmetrical about a midpoint of the third segment 230), the geometry of the attachment slot 150 may be such that the attachment slot 150 is asymmetrical. For example, the attachment slot 150 is asymmetrical when the first segment length 2101 is different than the second segment length 2201. Additionally or alternatively, the first segment 210 and the second segment 220 have different curvatures (e.g., different radii of curvature 214, 224) to cause asymmetry to the attachment slot 150. Optionally, the cut 200 may be configured such that only one of first segment 210 or the second segment 220 has a radius of curvature. As an example, the first segment 210 is generally linear and intersects the third segment 230 to form a desired angle (e.g., a right angle, an acute angle, or an obtuse angle). In this example, the second segment 220 has the second curvature 222 such that the third segment 230 intersects the second segment 220 at the second radius of curvature 224.

In some implementations, the cut 200 defines an inner flexible material region 240 and an outer flexible material region 250. The inner flexible material region 240 generally refers to an area at an attachment site 130 surrounded by the first segment 210, the second segment 220, and the third segment 230. In some examples, the inner flexible material region 240 includes an area that extends from the third segment 230 to an axis $A_P$ formed between the first cut end 202, 202*a* and the second cut end 202, 202*b* (e.g., FIG. 2C). For example, as depicted in FIG. 2A, the inner flexible material region 240 is partially enclosed by the first segment 210, the second segment 220, and the third segment 230 such that these segments 210-230 form three sides of the inner flexible material region 240. The outer flexible material region 250 refers to an area at an attachment site 130 that is not surrounded by the first segment 210, the second segment 220, and the third segment 230. In some examples, the outer flexible material region 250 spans all area of the attachment site 130 except the inner flexible material region 240.

FIG. 2A is an example of the cut 200 being U-shaped. With the U-shaped geometry, the first direction $D_1$ of the first segment 210 and the second direction $D_2$ of the second segment 220 both extend in the same direction. Here, the first segment 210 and the second segment 220 are parallel to each other and are of equal length. In this example, the cut 200 is symmetrical such that the first radius of curvature 214 is equal or about equal to the second radius of curvature 224. As FIG. 2A depicts, the third segment 230 is generally linear and extends tangentially from the first segment 210 to the second segment 220. Moreover, FIG. 2A illustrates that both the first segment 210 and the second segment 220 each have radii of curvature resulting in each segment 210, 220 being concave with respect to the inner flexible material region 240.

FIG. 2B is an example of an attachment site 130 with an array of attachment slots 150, 150*a-n*. Here, the array is a two by two array with four cuts 200, 200*a-d*. As FIG. 2B depicts, each cut 200 of the array shares similarities to the other cuts 200 from FIGS. 2A-2F except for alignment of features of the four cuts 200, 200*a-d*. Moreover, although FIG. 2B depicts the each cut 200 of the array resembling the cut 200 from FIG. 2A, any shape cut 200 may be arrayed like FIG. 2B. Additionally or alternatively, the array may array different shaped cuts 200 together in the same array. For example, rather than all the cuts 200, 200*a-n* of the array being the same shape (e.g., the U-shape of FIG. 2B).

Referring to FIG. 2B, in some examples, horizontally adjacent cuts 200, 200*a-n*, (e.g., the first cut 200, 200*a* and the second cut 200, 200*b* or the third cut 200, 200*c* and the fourth cut 200, 200*d*) horizontally align with a horizontal spacing of $S_H$. In these examples, horizontally adjacent cuts 200, 200*a-n* may align such that a horizontal axis $A_H$ passes through each intersection of the horizontally adjacent cuts 200, 200*a-n*. For example, the horizontal axis $A_H$ passes through the first intersection $I_{1a}$ of the first cut 200, 200*a*, the second intersection $I_{2a}$ of the first cut 200, 200*a*, the first intersection $I_{1b}$ the second cut 200, 200*b*, and the second intersection $I_{2b}$ of the second cut 200, 200*b*. In some examples, each third segment 230 of horizontally adjacent cuts 200, 200*a-n* extends along the horizontal axis $A_H$. Here, the third segment 230, 230*a* of the first cut 200, 200*a* and the third segment of the second cut 200, 200*b* extend along the horizontal axis $A_H$. In other words, the third segment 230, 230*a* of the first cut 200, 200*a* and the third segment of the second cut 200, 200*b* are horizontally spaced apart, but collinear. In some configurations, horizontally aligned cuts have a horizontal spacing $S_H$ of ⅜" for compatibility with PALS.

In some implementations, vertically adjacent cuts 200, 200*a-n* (e.g., the first cut 200, 200*a* and the third cut 200, 200*c* or the second cut 200, 200*b* and the fourth cut 200, 200*d*) vertically align with a vertical spacing $S_V$. In some examples, the vertical alignment between vertically adjacent cuts 200, 200*a-n* is such that each of the cut ends 202 (e.g., the first cut ends 202, 202*a* or the second cut ends 202, 202*b*) are collinear along a vertical axis Av. For example, FIG. 2B illustrates that the first cut ends 202, 202*a* of the first cut 200, 200*a* and the third cut 200, 200*c* are collinear along a first vertical axis $A_{V1}$. In other examples, for vertically adjacent cuts 200, 200*a-n*, the first cut ends 202, 202*a* are collinear along a first vertical axis $A_{V1}$ while the second cut ends 202, 202*b* are also collinear along a second vertical axis $A_{V2}$. Additionally or alternatively, each first segment 210 and/or second segment 220 of vertically adjacent cuts 200, 200*a-n* extends along the first vertical axis $A_{V1}$ and/or the second vertical axis $A_{V2}$, respectfully. For example, in FIG. 2B, the first segment 210 of the first cut 200, 200*a* and the first segment 210 of the third cut 200, 200*c* are collinear along the first vertical axis $A_{V1}$. In some examples, when two cuts are vertically aligned, each of the third segments 230 of the two vertically aligned cuts (e.g., the first cut 200, 200*a* and the third cut 200, 200*c*) is spaced apart from each other yet parallel. In some configurations, vertically aligned cuts have a vertical spacing $S_V$ of 1" for compatibility with PALS.

FIGS. 2C-2F are other examples of attachment slots 150 where the cut 200 varies in shape. FIG. 2C is an example where the third segment 230 intersects the first radius of curvature 214 and the second radius of curvature 224 non-tangentially. For example, the dotted line in FIG. 2C indicates a position where the third segment 230 would be located if the third segment 230 of the cut 200 intersected each of the first segment 210 and the second segment 220 tangentially.

FIG. 2D is an example where at least one of the first segment 210 or the second segment 220 has more than one radius of curvature 214, 224. Here, both the first segment 210 and the second segment 220 have two radii of curvatures such that each of the first segment 210 and the second segment 220 have portions that are concave and convex with respect to the inner flexible material region 240. In this example, the first segment 210 and the second segment 220 extend in opposite directions. In some carrier 100 designs, such as FIGS. 2D and 2F, a downward force F on the attachment slot 150 causes a force perpendicular to a portion of the first segment 210 and/or the second segment 220. This design that exhibits a force perpendicular to a portion of the first segment 210 and/or the second segment 220 may distribute less force around the curvature of the first segment 210 and/or second segment 220. In high stress situations, this design may be less desirable. Yet where high stress situations are unlikely, designs such as FIGS. 2D-2E may offer greater manufacturing throughput. For example, when cut of FIG. 2D is cut with a laser cutter, the laser cutter rapidly cuts adjacent cuts because each cut end 202 aligns with an adjacent cut end 202 (e.g., minimizing laser cutter gantry movement).

Figure 2F:
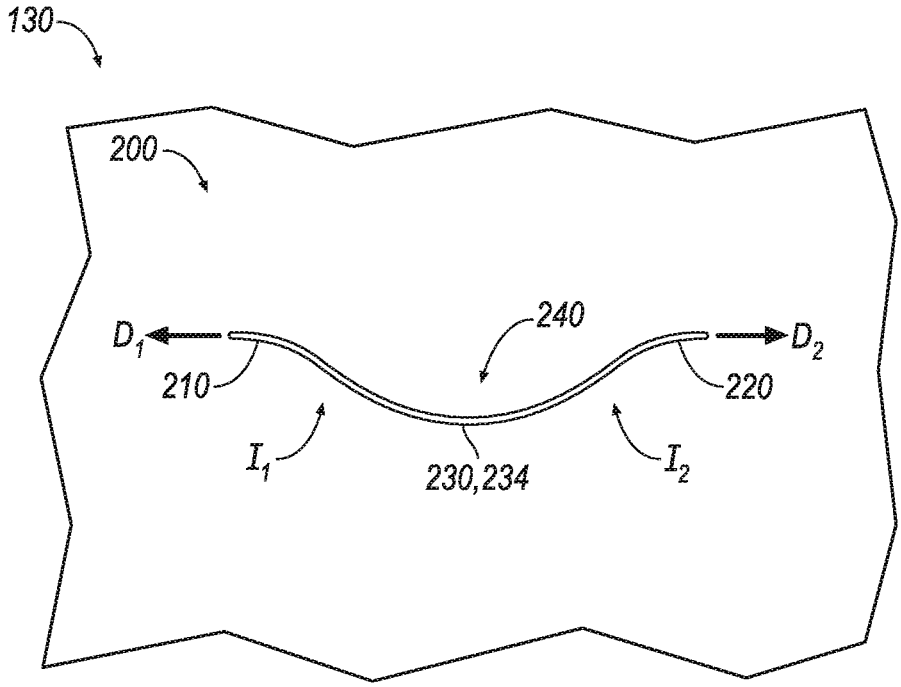

FIGS. 2E and 2F are examples of the attachment slot 150. In these examples, the third segment 230 is non-linear. As non-linear, the third segment 230 may have at least one radius of curvature 234. For example, FIG. 2E depicts the third segment 230 with a radius of curvature 234 that defines a convex curvature with respect to the inner flexible material region 240. Comparatively, FIG. 2F depicts the third segment 230 with a radius of curvature 234 that defines a concave curvature with respect to the inner flexible material region 240.

In some examples, the cut 200 has uniform width 200*w* such that the first segment 210, the second segment 220, and the third segment 230 all have the same width w. In other examples, the width of the cut 200 may vary between segments 210-230. In some implementations, the cut width 200*w* corresponds to a dimension of a cutter that produces the attachment slot 150. For example, the cut width 200*w* corresponds to a width of a knife edge (e.g., a bevel width). As another example, the cutter is a laser cutter with a beam diameter that corresponds to the cut width 200*w*. In some examples, such as the laser cutter, the flexible material (e.g., fabric) used to form the cut 200 melts due to energy transferred from the cutter (e.g., laser cutter) to the flexible material. Some examples of cutting processes that may form the cut 200 within the flexible material are laser cutting, heated die cutting, ultrasonic welding, and heat staking.

In configurations with heat formation for the attachment slot 150, the melting of the flexible material may prevent cut edges from fraying at cut formation and also prevent further latent fraying of unraveling of the cut edges. Generally when a flexible material is cut, the cut shears the fibers of the flexible material causing the cut edges to become exposed and susceptible to fraying and/or unraveling. Although this susceptibility to fraying may depend on the structure of the flexible material (e.g., woven, non-woven, type of weave, etc.), Here, the melting of the flexible material (e.g., fabric) at the cut edges seals fibers of the flexible material as the cutter forms the cut.

Although FIGS. 2A-2F depict some examples of attachment slots 150, an attachment slot 150 may be designed with any geometry capable of securing the tactical equipment attachment 140 to a carrier 100. For example, an attachment slot 150 may be a traditional rectangular shape sized to receive an attachment portion 142 (e.g., a MOLLE attachment portion) of the tactical equipment attachment 140. In other configurations, an attachment site 130 may include a plurality of attachment slots 150 with different geometries to accommodate for any tactical equipment attachment 140 and/or for any style of attachment portion 142 of the tactical equipment attachment 140 that may be secured to a carrier 100.

Figure 3B:
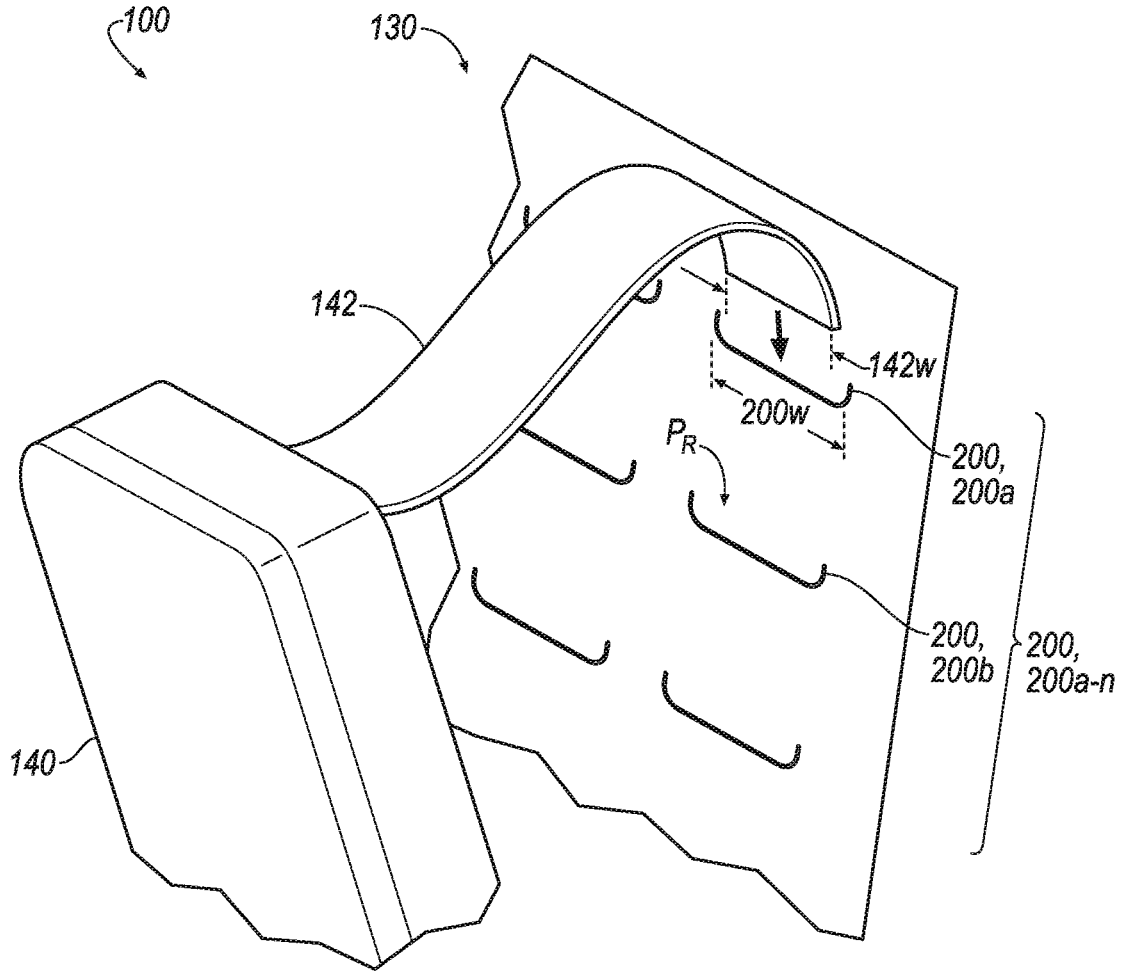
FIGS. 3B-3D are perspective views of an example of a tactical attachment being secured to a carrier via an attachment slot.
Figure 3C:
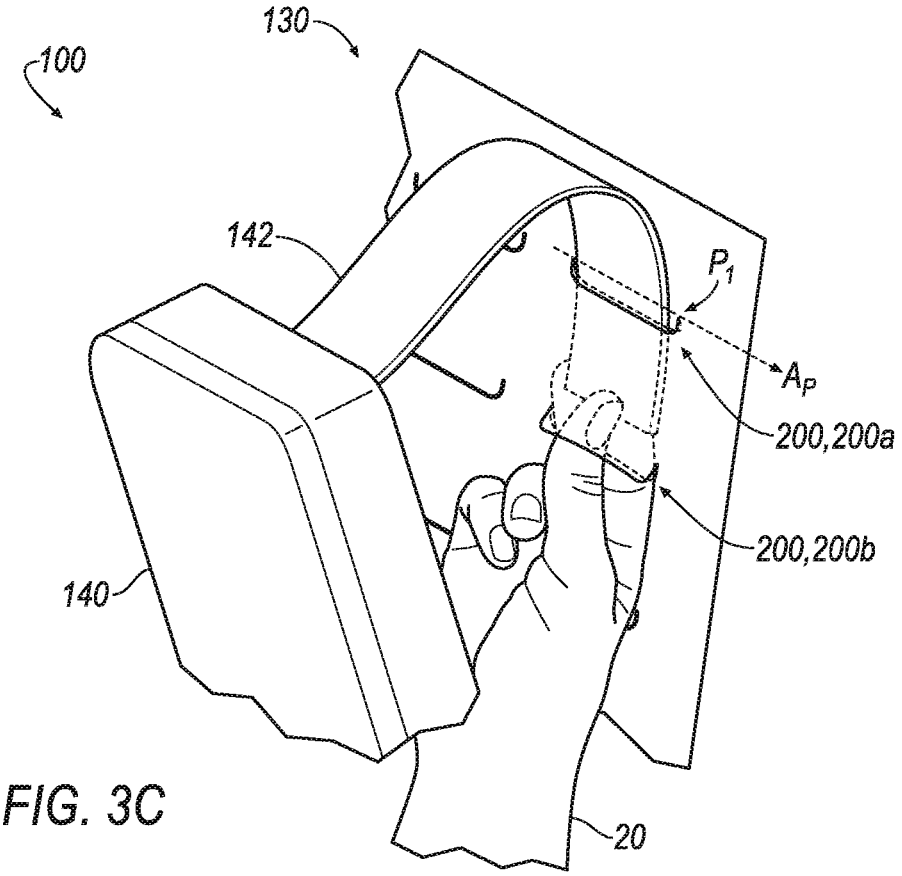
Figure 3D:
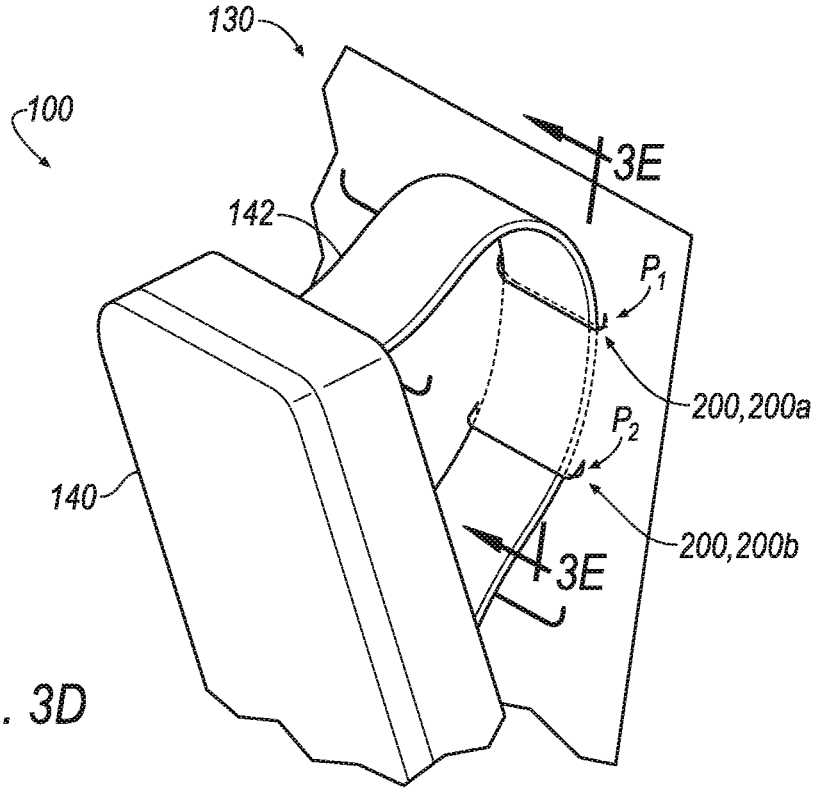

FIGS. 3A-3E depict examples of how a tactical attachment 140 attaches to an attachment slot 150 within an attachment site 130 of a carrier 100. FIG. 3A depicts a portion of a carrier 100 at an attachment site 130 where a tactical attachment 140 is secured to the carrier 100. Here, the tactical attachment 140 is a pouch with an ammo clip. FIGS. 3B-3D illustrate how the tactical attachment 140 of FIG. 3A becomes attached to the carrier 100. Referring to FIG. 3B, in some examples, an attachment portion 142 of the tactical attachment 140 feeds downward (as shown by an arrow) through a first cut 200, 200*a* towards an interior of the carrier 100 and the second cut 200, 200*b*. Here, the attachment portion 142 is a flat strap (e.g., a MOLLE nylon webbing strap) that has a width 142*w* less than or equal to a width 200*w* of the first cut 200, 200*a*. In this example, the width 200*w* of the first cut 200, 200*a* is defined by the third segment length 2301.

Figure 3E:
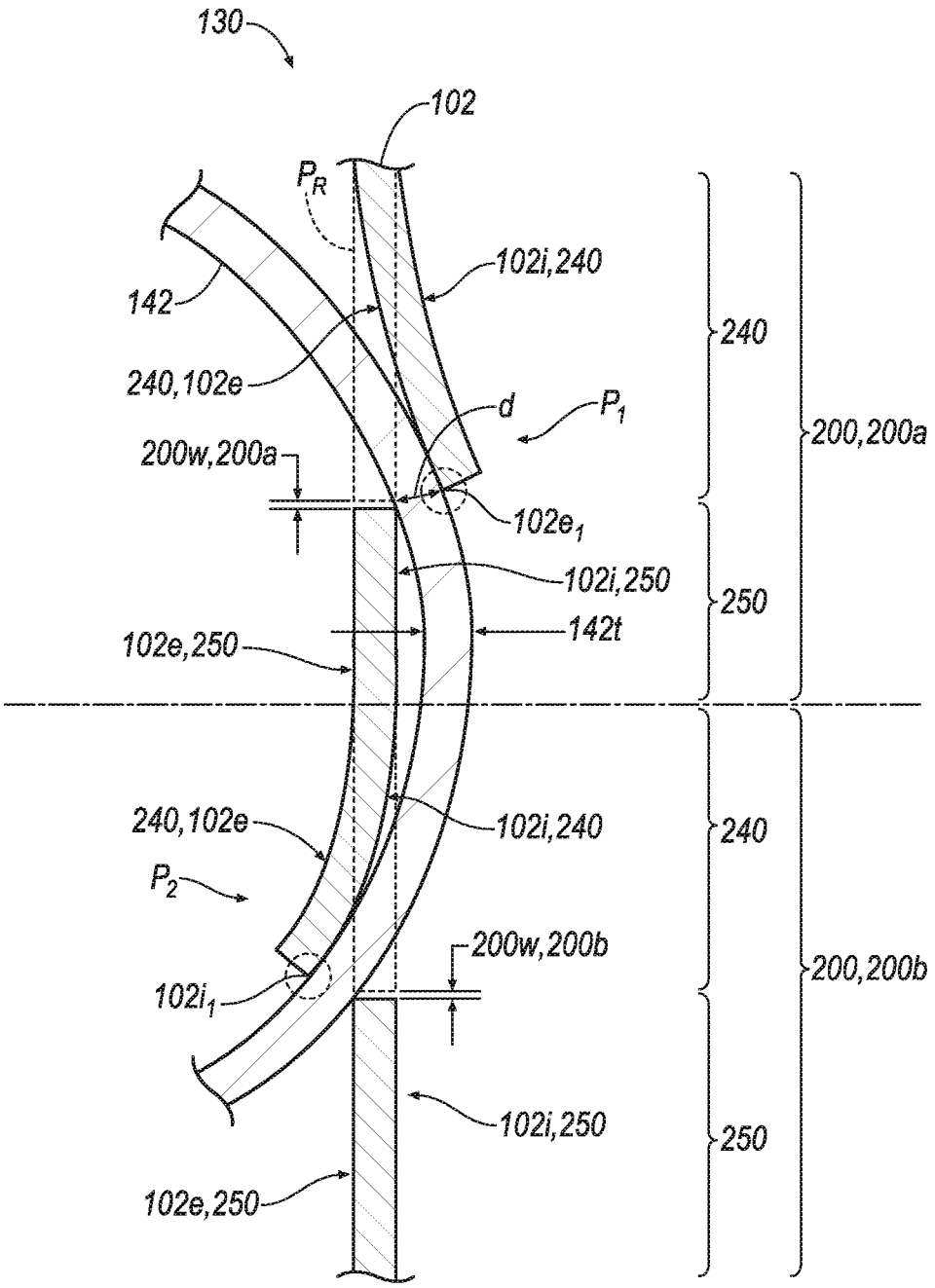
FIG. 3E is a side sectional view of FIG. 3D along the line 3E-3E.

As shown by FIG. 3C-3E, in some examples, the inner flexible material region 240 of the cut 200 is a pivotable tab or flap such that the inner flexible material region 240 is movable relative to the outer flexible material region 250 between a first position $P_1$ and a second position $P_2$. In some implementations, the inner flexible material region 240 is pivotable upon a pivot axis $A_P$ extending from the first cut end 202, 202*a* to the second cut end 202, 202*b* (e.g., as shown in FIG. 2C). Referring to FIG. 3C, in some examples, when receiving the attachment portion 142 (e.g., the strap), the pivotable tab moves to the first position $P_1$ by pivoting toward the wearer 20 of the carrier 100. The pivotable tab may pivot from a resting position PR (e.g., as shown in FIG. 3B) where the inner flexible material region 240 and the outer flexible material region 250 are substantially planar.

When the attachment portion 142 is inserted into the first cut 200, 200*a*, the wearer 20 may pull the attachment portion 142 towards and through the second cut 200, 200*b* by inserting the wearer's fingers into the second cut 200, 200*b* as shown in FIG. 3C. To pull and weave the attachment portion 142 out of the second cut 200, 200*b*, the pivotable tab of the second cut 200, 200*b* may move to the second position $P_2$ by pivoting away from the wearer 20. By pivoting outward and away from the wearer 20, the pivotable tab may have less interference making it easier to weave the attachment portion 142 through the cuts 200, 200*a-b*. Additionally or alternatively, the ability of the inner flexible material region 240 to pivot allows access behind the flexible material layer when, traditionally, access behind flexible material panels of carriers 100 was limited causing difficulty when weaving attachment straps 142 to these carriers 100.

FIGS. 3D and 3E are examples of when the attachment portion 142 has been woven through the first cut 200, 200*a*, the second cut 200, 200*b*, and back to the tactical attachment 150. FIG. 3E is side view of an example of the attached tactical attachment 140. Here, the first cut 200, 200*a* pivoted from the resting position PR to the first position $P_1$. FIG. 3E designates the resting positions PR of both the first cut 200, 200*a* and the second cut 200, 200*b* by dotted lines. In these examples, the first cut 200, 200*a* swings towards the wearer 20 of the carrier 100. For instance, at first position $P_1$, a portion $102e_1$ of the exterior surface 102*e* of the inner flexible material region 240 adjacent the third segment 230 of the first cut 200, 200*a* extends beyond the interior surface 102*i* of the outer flexible material region 250. FIG. 3E depicts the inner flexible material region 240 (e.g., the pivotable tab) extending beyond the interior surface 102*i* of the outer flexible material region 250 a distance d corresponding to a thickness 142*t* of the attachment portion 142. Referring further to FIG. 3E, FIG. 3E depicts the second cut 200, 200*b* in the second position $P_2$ to permit the attachment portion 142 to exit the flexible material of the carrier 100. In the second position $P_2$, a portion 102*i*1 of the interior surface 102*i* of the inner flexible material region 240 of the second cut 200, 200*b* adjacent the third segment 230 extends beyond the exterior surface 102*e* of the outer flexible material region of the second cut 200, 200*b*. The second cut 200, 200*b* transitions from the resting position PR to the second position $P_2$ by pivoting away from the wearer 20.

Figure 4A:
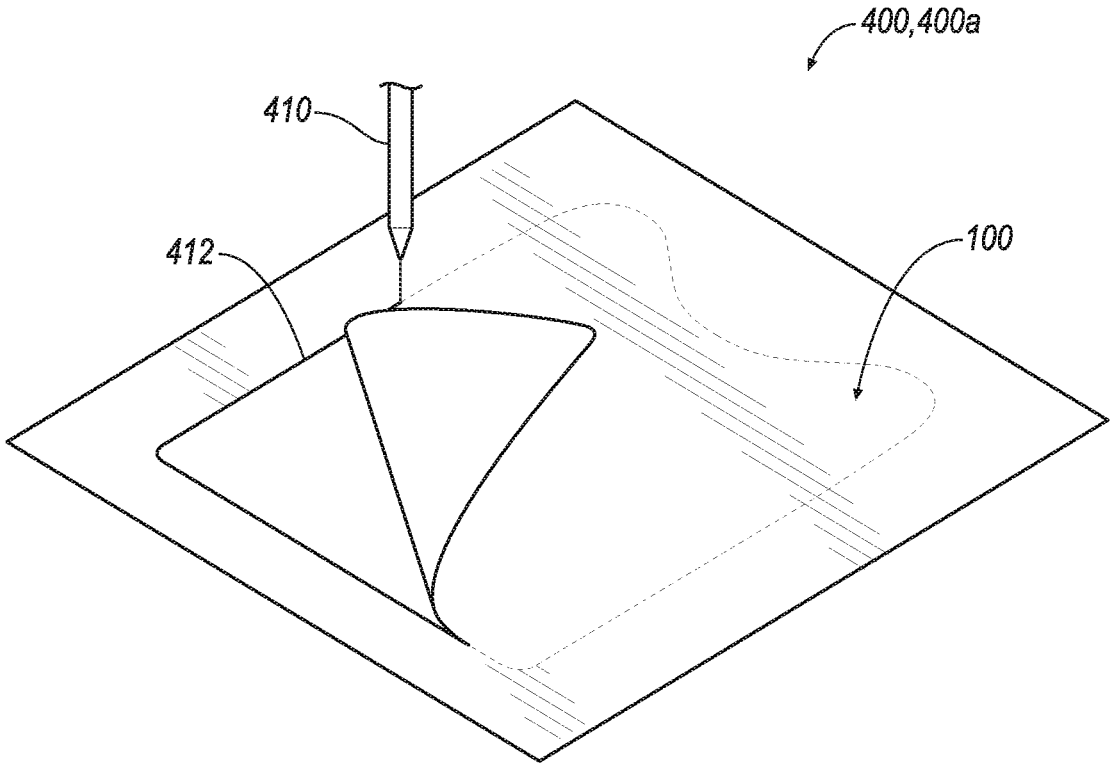
FIGS. 4A and 4B are perspective views of example carrier fabrication processes.
Figure 4B:
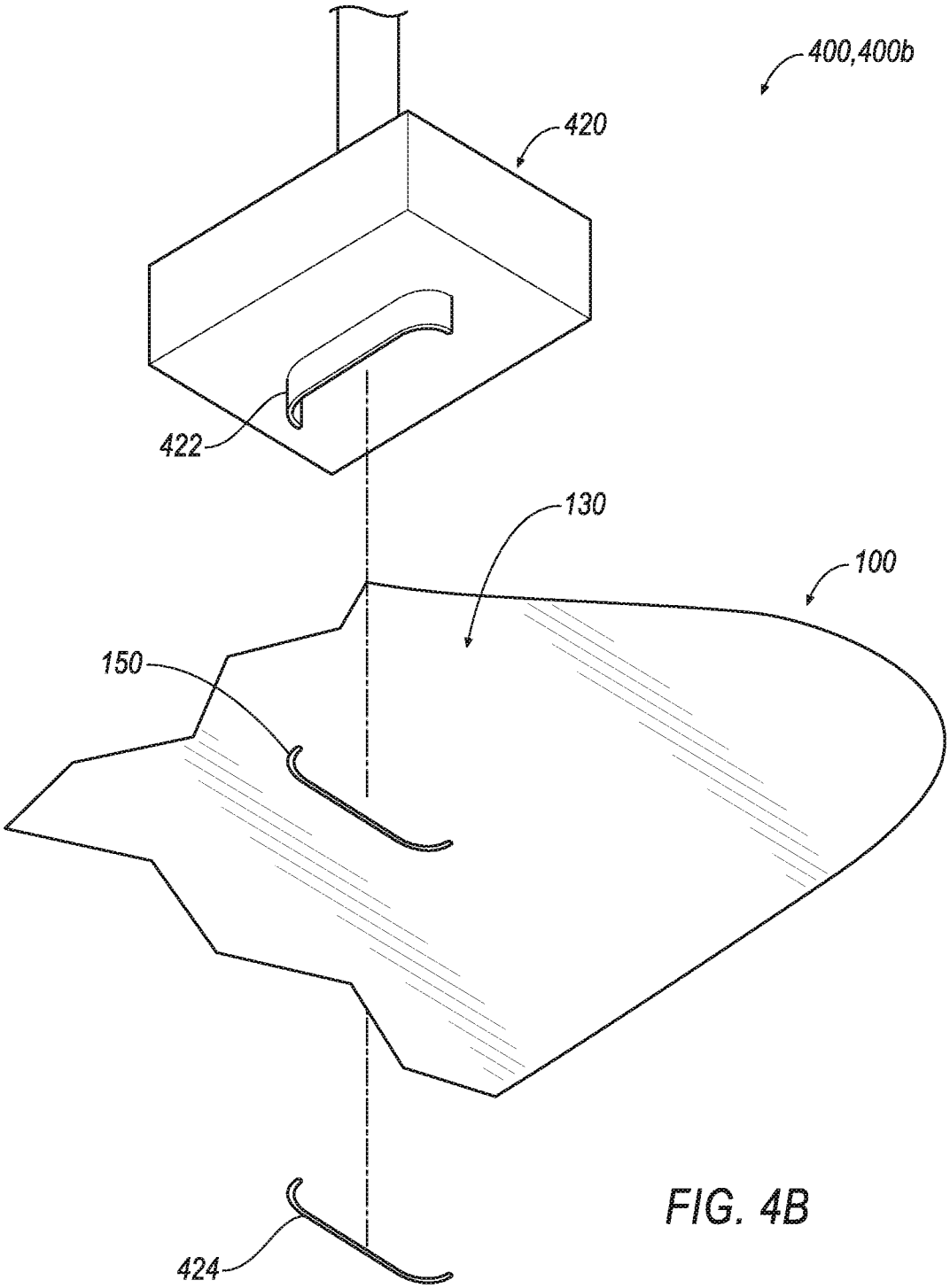

FIGS. 4A and 4B are examples of carrier fabrication processes 400, 400*a-b*. Each fabrication process 400 includes at least one cutting system, such as, for example, a laser cutter 410 (referred to as a laser) or a die cutter 420. Although the carrier 100 and the attachment site(s) 130 may be fabricated using any cutting process, some processes may integrate a singular cutting approach (e.g., only laser cutting or only die cutting) or a hybrid cutting approach. As an example, the combination of FIGS. 4A and 4B depict a hybrid cutting process. Here, in FIG. 4A, the carrier 100 is cut with a laser 410. An operator or fabricator programs the laser with cut coordinates or a cut profile 412. In some implementations, the laser 410 cuts a portion of the carrier 100 (e.g., a chest panel, a shoulder panel, a cummerbund, a back panel, a stomach panel, etc.). For example, as illustrated by FIG. 4A, the laser 410 cuts, according to the cut profile 412, an outline of a panel of the carrier 100 that includes an attachment site 130.

In some examples, the laser cutter 410 permits fabrication flexibility by easily varying laser speed and/or laser power depending on the intricacies of the cut profile 412 and/or the material to be cut by the laser 410. Moreover, a laser cutter 410 may be utilized in the fabrication process to reduce the use of fabrication dies or to process cuts over large areas. For example, some die cutting machines require punching forces proportional to an amount of die cutting edges 422. In other words, as the die cutting area or an amount of features within a design increase the amount of die cutting edges 422, fabrication demands die cutting machines capable of greater power (e.g., pressure/tonnage). In contrast, a laser cutter 410 may not need to increase its laser power as the die cutting area or the amount of features increase for a design.

In a hybrid cutting approach, a secondary fabrication process (e.g., the fabrication process 400, 400*b* of FIG. 4B) cuts another feature of the carrier 100 or features of the carrier design remaining to be cut after a first fabrication process (e.g., the fabrication process 400, 400*a* of FIG. 4A). FIG. 4B is an example of a die cutting process 400, 400*b* as a secondary fabrication process. Here, the die cutting process 400, 400*b* includes a die 420 with a cut edge 422 (e.g., a steel rule) corresponding to a feature to be punched out of the material. In this example, the die 420 has a steel rule cut edge 422 shaped as an attachment slot 150 to form the attachment slot 150. In some examples, the die cutting process 400, 400*b* may include a single stage die 420 or multiple die stages to form the carrier 100 or a feature of the carrier 100. Alternatively, the die cutting process 400, 400*b* may precede the laser cutting process 400, 400*a* such that the laser cutting process 400, 400*a* as shown in FIG. 4A is the secondary fabrication process.

In some configurations, attachment site(s) 130 include a plurality of attachment slots 150. In these configurations, a total fabrication time to fabricate the carrier 100 with attachment slots 150 incrementally increases with each attachment slot 150 programmed to be cut by a laser cutter 410. Therefore, although a laser cutter 410 may have some advantages (e.g., small run flexibility, an overall reduction of cutting power, etc.), a hybrid cutting approach for fabricating the carrier 100 may enable greater throughput by decreasing total fabrication time. For example, the hybrid approach, such as laser cutting and die-cutting, enables parallel processing. Additionally or alternatively, a die cutting process may include a die 420 with an array of cut edges 422 to form a plurality of attachment slots 150 in one punch.

Figure 5:
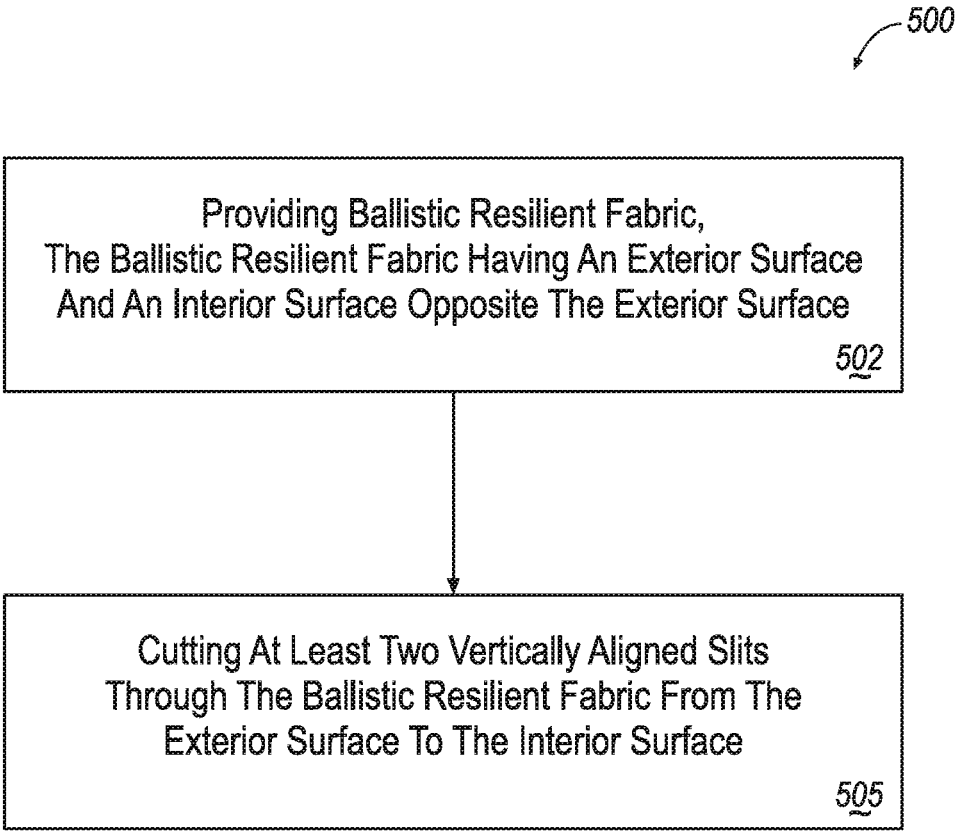
FIG. 5 is a flow diagram of an example method of forming an attachment slot.

FIG. 5 is a flow diagram illustrating an example method 500 of forming the attachment slot 150. At block 502, the method 500 provides ballistic resilient flexible material having an exterior surface 102*e* and an interior surface 102*i*. At block 504, the method 500 cuts at least two vertically aligned cuts 200, 200*a-b* through the ballistic resilient flexible material from the exterior surface 102*e* to the interior surface 102*i*. At block 504, each cut 200 includes a first cut end 202*a*, a second cut end 202*b*, a first segment 210, a second segment 220, and a third segment 230. Here, the first segment 210 extends from the first cut end 202, 202*a* to the third segment 230. The first segment 210 has a first curvature 212 defined by a first radius of curvature 214 at a first intersection $I_1$ between the first segment 210 and the third segment 230. Similarly, the second segment 220 extends from the second cut end 202, 202*b* to the third segment 230. The second segment 220 has a second curvature 222 defined by a second radius of curvature 224 at a second intersection $I_2$ between the second segment 220 and the third segment 230. The third segment 230 has a first segment length 2301 extending from the first intersection $I_1$ to the second intersection $I_2$. In some examples, each cut 200 of the method 500 is pivotable along an axis $A_P$ extending from the first cut end 202*a* to the second cut end 202*b*. In some implementations, each edge of the cut 200 of the method 500 includes sealed, unraveled fibers of the ballistic resilient flexible material. Additionally or alternatively, at block 504, cutting by the method 500 includes melting the ballistic resilient flexible material. Here, melting the ballistic resilient flexible material may include a laser cutter that melts the ballistic resilient flexible material.

Figure 6A:
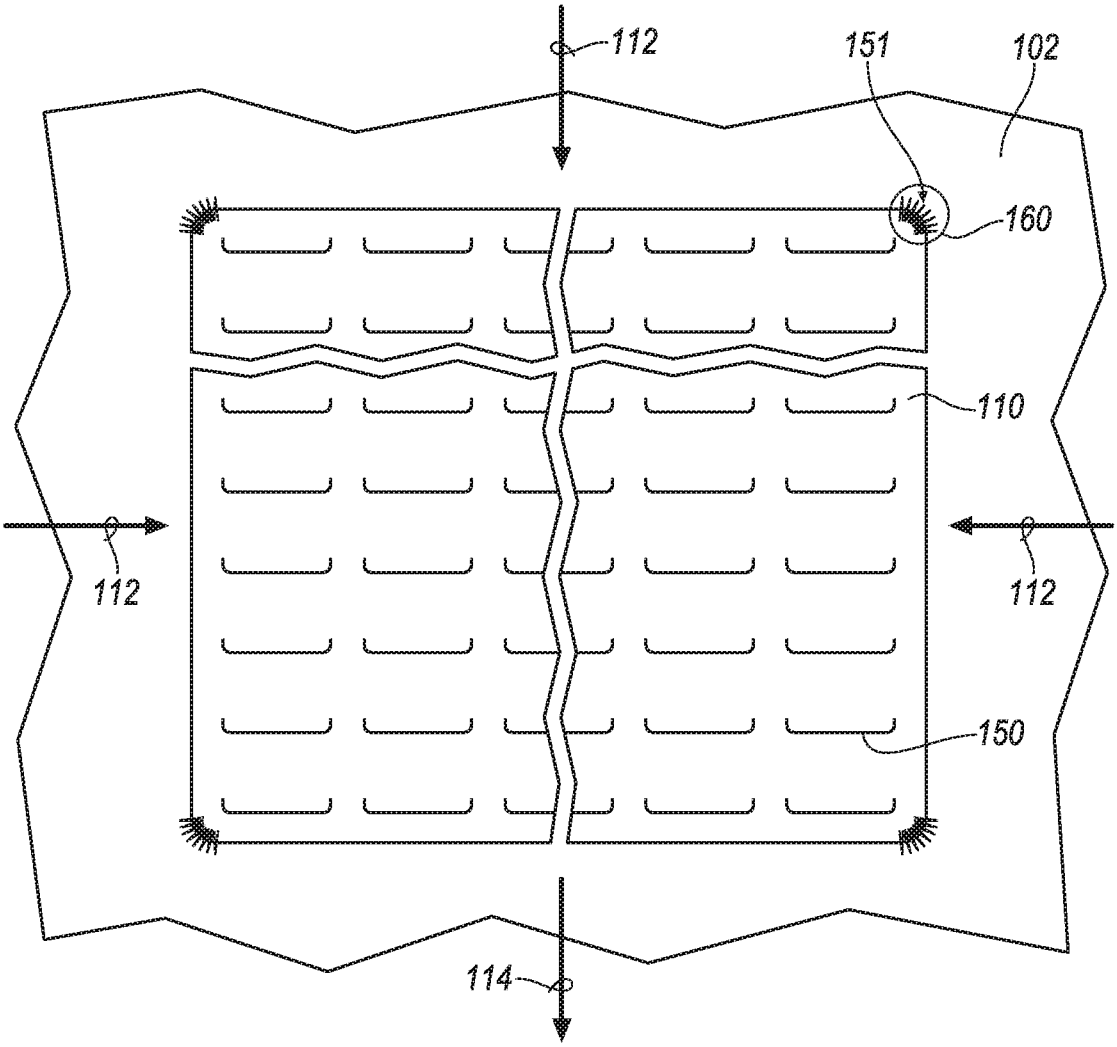
FIG. 6A-6D depict various schemes for attaching flexible material panel to carrier.

Now referring to FIG. 6A, flexible material panel 110 may be attached to base 102. In some implementations, base 102 can be carrier 100 as has previously been discussed herein. However, base 102 can be any wearable, or portion of any wearable including, without limitation, cummerbund, jacket, coat, shirt helmet, pants, boots, gloves or the like. Flexible material panel 110 can be fabricated from any material that is flexible. Flexible material panel 110 can have ballistic resistant properties but ballistic resistant properties of panel 110 are not necessary or essential to this invention. Flexible material panel 110 includes a plurality of attachment slots, one of which is exemplified by slot 150 in FIG. 6A. Slots 150 can have any number of geometries as has already been discussed herein. Slots 150 pass completely through flexible material panel 110, but in an embodiment, they do not penetrate into base 102.

Flexible material panel 110 can be affixed to base 102 using any number of methods including joining thereto using traditional sewing techniques, chemical adhesives, welding (including vibration welding), heat staking/fusing by way of applying heat, pressure, or the combination of the two (including using heat sources powered by electrical heating elements and lasers), fasteners including snaps, rivets, buckles, hook and loop fasteners, zippers, staples and the like. In the embodiments of FIG. 6A-6D the technique for joining base 102 and flexible material panel 110 is graphically depicted as sewing (i.e. stitching) but it is contemplated that any of the above methods for joining (or their equivalents) can be implemented in carrying out this invention. In an embodiment, FIG. 6A depicts attaching flexible material panel 110 to base 102 by way of stitches located in a plurality of corners 151 (exemplified at zone 160). Although flexible material panel 110 is shown having four distinct corners (each of which is stitched to base 102), it is contemplated that other geometries used for flexible material panel 110 may use more, or less, than four stitch zones depending on how many corners a particular flexible material panel 110 may have. For example, a flexible material panel 110 having a triangular shape may only require three stitch zones (one stitched zone for each triangle corner). Except for the stitching zones (where the flexible material panel 110 is securely attached to base 102), the volume V partially defined by a forward facing surface of base 102 and an adjacent, rearward facing surface of flexible material panel 110) is not enclosed and therefore freely allows the ingress 112 and egress 114 of debris into and out of the volume V.

Figure 6B:
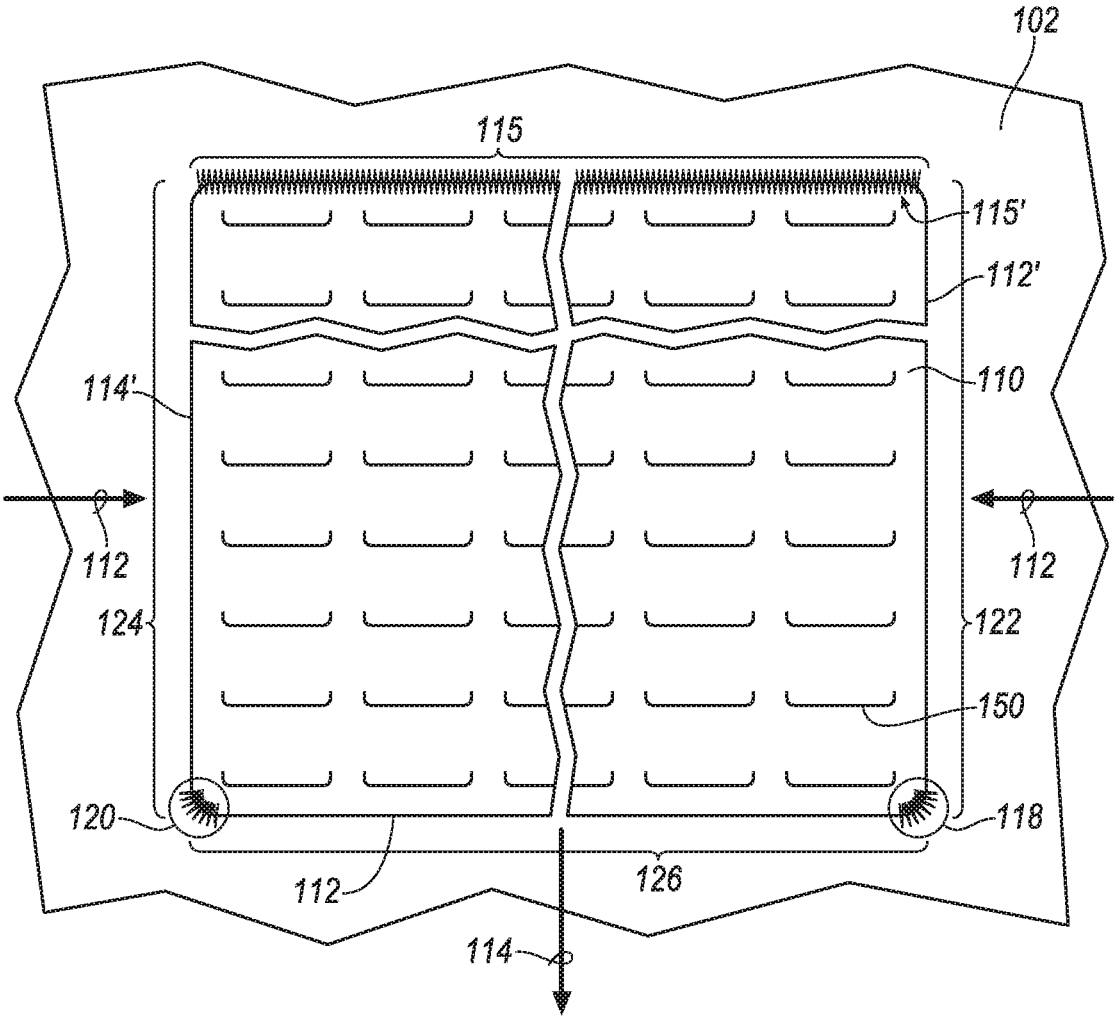

Now referring to FIG. 6B, in an alternative attachment scheme, flexible material panel 110 is attached to base 102 by way of a substantially continuous (i.e. substantially uninterrupted) stitch 115' located continuously along the top edge 115 of flexible material panel 110. Additionally, the bottom right corner 118 and the bottom left corner 120 are stitched similarly to zone 160 described in conjunction with FIG. 6A. In this embodiment, the substantially continuous stitch at 115' along the top portion of flexible material panel 110 significantly impedes or prevents the ingress of particulate matter through the seam along the top edge 115 of flexible material panel 110; however, particulate debris is free to enter into the volume V by way of side openings 112', 114' formed along the right edge 122, and the left edge 124 and is free to exit the volume V by way of the bottom opening 117' formed between bottom edge 126 of flexible material panel 110 and base 102. One functional advantage of attaching flexible material panel 110 to base 102 in the way depicted in FIG. 6B is that if the wearer is "belly" crawling along the terrain, and the flexible material panel 110 is attached to the belly portion of the wearer's garments, the seam along the top edge 115 of flexible material panel 110 will prevent the flexible material panel 110 from acting as a scoop to collect debris and funnel the debris into the volume V.

Figure 6C:
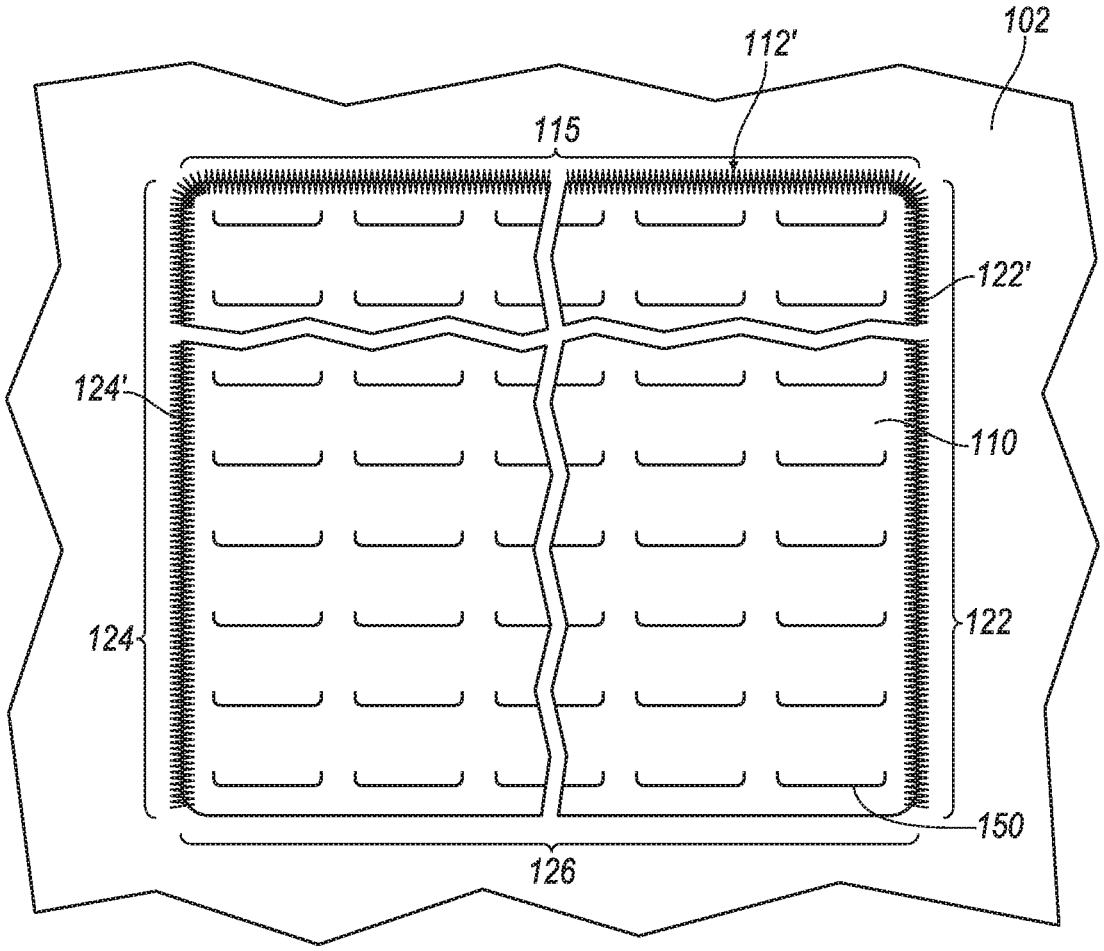

Now referring to FIG. 6C, and an optional 3rd embodiment, the top edge 115 of flexible panel material 110 along with the right edge 122 and the left edge 124 of same are sewn in a substantially continuous matter to that as described in conjunction with top edge 115 shown in FIG. 6B. By sewing these three edges in this manner, debris is significantly impeded or prevented from entering the volume V from the top opening 112', right opening 122', or the left opening 124'. Debris is still capable of entering into the volume V by way of one or more of the attachment slots 150 and/or through the bottom edge 126 which is not attached to base 102. By leaving the bottom edge 126 of flexible material panel 110. Any debris that does make its way into the volume V is easily evacuated therefrom by way of the bottom opening 117'.

Figure 6D:
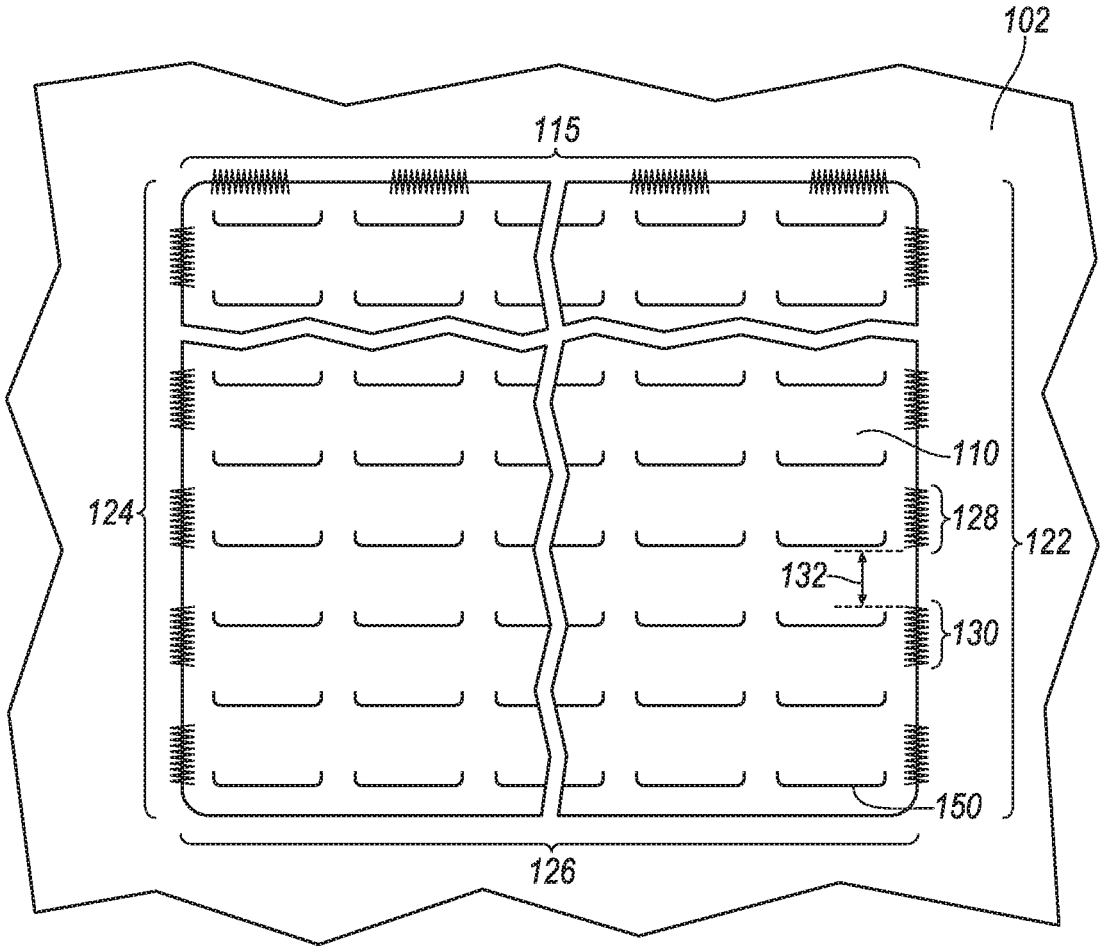

Now referring to FIG. 6D, in still another embodiment, the right edge 122, left edge 124, and top edge 115 are all attached to base 102 but they are not attached in a substantially continuous manner. Rather, they are attached in an interrupted manner wherein adjacent stitching segments 128, 130 are separated by non-stitched segments 132. Optionally, bottom edge 126 may be left completely unstitched (as shown in FIG. 6D) or it may be stitched using the interrupted stitch scheme shown along edges 115, 122, and 124. In none of the embodiments shown herein is the bottom edge 126 sewn substantially continuously to base 102. If it were so sewn, it would not allow debris to be evacuated from the volume V. Edges 115, 122, and 124 are generically referred to as non-bottom edges. A bottom edge is any edge that at least partially defines an opening into a volume V at least partially bounded by a forward facing surface of base 102 and an adjacent, rearward facing of flexible material panel 110, and which opening is facing at least partially downwardly during customary use of the wearable to which the panel 110 is attached such that debris contained in said volume V will be acted on by gravity to be evacuated from said volume V by way of opening 117' defined by said bottom edge.

Figure 6E:
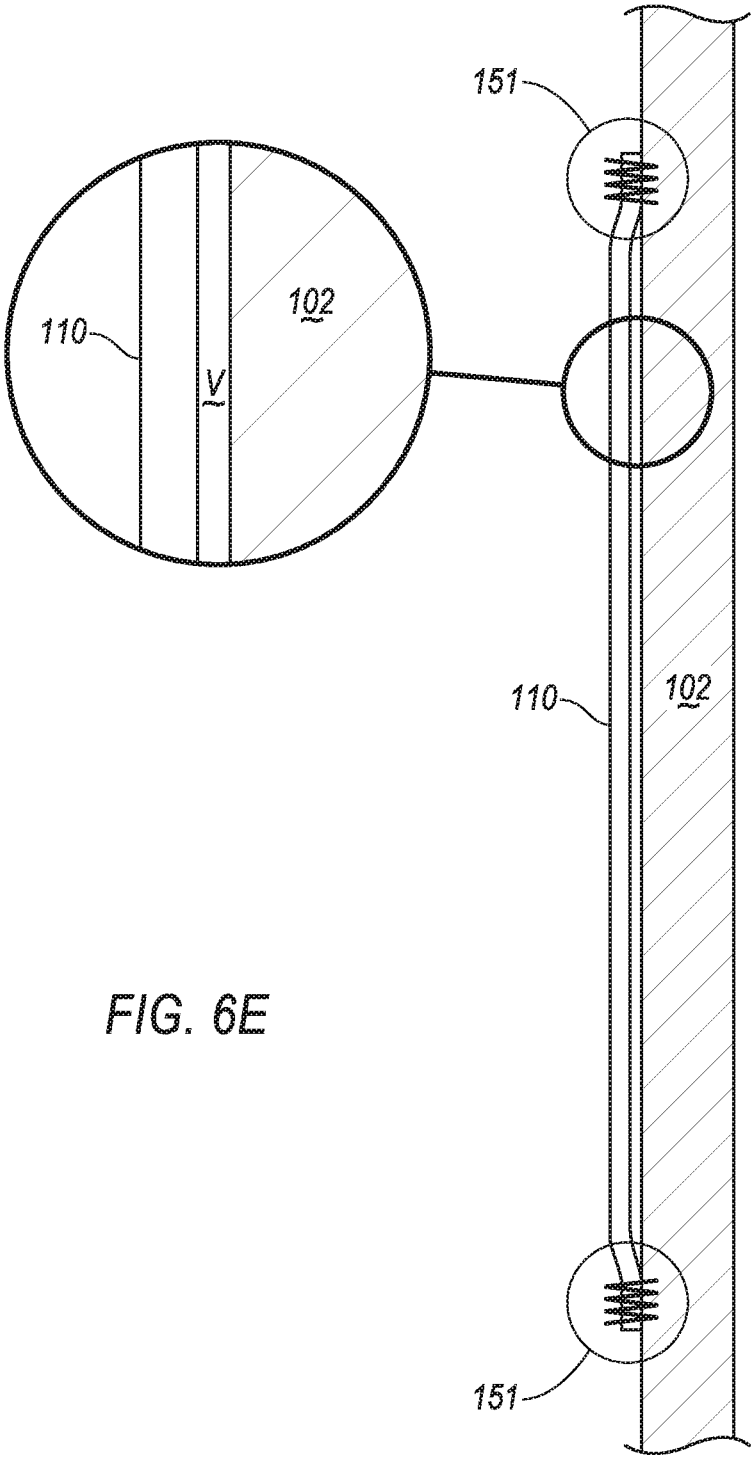
FIG. 6E is a diagrammatic view of volume V partially defined by flexible material panel and base.

FIG. 6E schematically depicts volume V as it is partially defined (i.e. bounded) by flexible material panel 110 and base 102.

A number of implementations have been described. Nevertheless, it will be understood that various modifications may be made without departing from the spirit and scope of the disclosure. Accordingly, other implementations are within the scope of the following claims.

What is claimed is:

1. An attachment system for securing an attachment accessory, the attachment system comprising:

a wearable carrier formed at least in part from a flexible material having an outer surface and an inner surface opposite the outer surface; and an attachment slot formed through the flexible material and configured to receive a strap of the attachment accessory, the attachment slot defining a pivotable tab and extending from a first end to a second end and including a first segment, a second segment, and a third segment, the first segment extending from the first end to the second segment, the second segment extending from the first segment to the third segment, the third segment extending from the second segment to the second end, the first segment and the second segment defining a first non-orthogonal angle therebetween, and the third segment and the second segment defining a second non-orthogonal angle therebetween, wherein the attachment slot is formed by a first cut defining an upper cut edge and a lower cut edge of the attachment slot, the upper cut edge forming a portion of the pivotable tab that is pivotable with respect to the lower cut edge, the lower cut edge receiving load bearing force from the attachment accessory when in a load bearing state, and in the load-bearing state, the lower cut edge distributes the load bearing force along the lower cut edge comprising the first segment, the second segment, and the third segment.

2. The attachment system of claim 1, wherein the first non-orthogonal angle is obtuse.

3. The attachment system of claim 2, wherein the second non-orthogonal angle is obtuse.

4. The attachment system of claim 1, wherein the first non-orthogonal angle is equal to the second non-orthogonal angle.

5. The attachment system of claim 1, wherein the first segment is defined at least in part by a first upper edge segment and a first lower edge segment opposite the first upper edge segment, the second segment is defined at least in part by a second upper edge segment and a second lower edge segment opposite the second upper edge segment, and the third segment is defined at least in part by a third upper edge segment and a third lower edge segment opposite the third upper edge segment.

6. The attachment system of claim 5, wherein the upper cut edge and the lower cut edge define a width extending therebetween in a direction orthogonal the upper cut edge and the lower edge from the first end of the attachment slot to the second end of the attachment slot.

7. The attachment system of claim 6, wherein the width is constant from the first end of the attachment slot to the second end of the attachment slot.

8. The attachment system of claim 5, wherein the first lower edge segment and the second lower edge segment define the first non-orthogonal angle, and wherein the second lower edge segment and the third lower edge segment define the second non-orthogonal angle.

9. The attachment system of claim 8, wherein the first non-orthogonal angle is obtuse and the second non-orthogonal angle is obtuse.

10. The attachment system of claim 5, wherein the first non-orthogonal angle is configured to distribute a force from the attachment accessory across the first lower edge segment and the second lower edge segment when the attachment slot receives the strap of the attachment accessory.

11. An attachment system for securing an attachment accessory, the attachment system comprising:

a wearable carrier formed at least in part from a flexible material having an outer surface and an inner surface opposite the outer surface; and an attachment slot formed through the flexible material and configured to receive a strap of the attachment accessory, the attachment slot formed at least in part by a cut defining an upper cut edge and lower cut edge including a first lower cut edge segment, a second lower cut edge segment extending from and non-orthogonal to the first lower cut edge segment, and a third lower cut edge segment extending from and non-orthogonal to the first lower cut edge segment, the upper cut edge forming a portion of a pivotable tab that is pivotable with respect to the lower cut edge, the lower cut edge receiving a load bearing force from the attachment accessory when in a load bearing state, and in the load bearing state, the lower cut edge distribute the load bearing force along the lower cut edge comprising, the first lower cut edge segment, the second lower cut edge segment, and the third lower cut edge segment.

12. The attachment system of claim 11, wherein the first lower cut edge segment and the second lower cut edge segment define a first non-orthogonal angle extending from a first intersection, and the third lower cut edge segment and the second lower cut edge segment define a second non-orthogonal angle extending from a second intersection.

13. The attachment system of claim 12, wherein the first non-orthogonal angle is obtuse.

14. The attachment system of claim 13, wherein the second non-orthogonal angle is obtuse.

15. The attachment system of claim 12, wherein the first non-orthogonal angle is equal to the second non-orthogonal angle.

16. The attachment system of claim 11, wherein the upper cut edge includes a first upper cut edge segment, a second upper cut edge segment, and a third upper cut edge segment, and wherein the first upper cut edge segment and the first lower cut edge segment define a first width extending therebetween in a direction orthogonal to the first upper cut edge segment and the first lower cut edge segment, the second upper cut edge segment and the second lower cut edge segment define a second width extending therebetween in a direction orthogonal the second upper cut edge segment and the second lower cut edge segment, and the third upper cut edge segment and the third lower cut edge segment define a third width extending therebetween in a direction orthogonal the third upper cut edge segment and the third lower cut edge segment.

17. The attachment system of claim 16, wherein the first width is equal to the second width and the third width.

* * * * *